US010657752B2

(12) United States Patent
Dietz

(10) Patent No.: US 10,657,752 B2
(45) Date of Patent: May 19, 2020

(54) DEVICE, ASSEMBLY, AND METHOD FOR INPUTTING AND/OR OUTPUTTING ONE OR A PLURALITY OF SECURITY DOCUMENTS

(71) Applicant: Wincor Nixdorf International GmbH, Paderborn (DE)

(72) Inventor: Oliver Dietz, Borchen (DE)

(73) Assignee: Winco Nixdorf International, GmbH, Paderborn (DE)

( * ) Notice: Subject to any disclaimer, the term of this patent is extended or adjusted under 35 U.S.C. 154(b) by 29 days.

(21) Appl. No.: 15/927,171

(22) Filed: Mar. 21, 2018

(65) Prior Publication Data

US 2018/0276932 A1 Sep. 27, 2018

(30) Foreign Application Priority Data

Mar. 21, 2017 (EP) ..... 17162051

(51) Int. Cl.
*G07D 11/13* (2019.01)
*G07F 19/00* (2006.01)
(Continued)

(52) U.S. Cl.
CPC ..... *G07D 11/13* (2019.01); *G07D 11/125* (2019.01); *G07D 11/14* (2019.01); *G07D 11/165* (2019.01);
(Continued)

(58) Field of Classification Search
CPC ..... G06Q 20/10; G07D 11/00; G07D 11/12; G07D 11/16; G07D 11/20–24; G07F 19/00; G07F 19/20
(Continued)

(56) References Cited

U.S. PATENT DOCUMENTS

2004/0012144 A1* 1/2004 Matzig ..... B65H 33/04 271/279
2008/0093437 A1* 4/2008 Henderson ..... G07F 19/20 235/379
(Continued)

FOREIGN PATENT DOCUMENTS

EP 0471300 A2 2/1992
EP 1913505 A2 4/2008

OTHER PUBLICATIONS

Extended European Search Report issued in the corresponding European application; 8 pages.

*Primary Examiner* — Edwyn Labaze
(74) *Attorney, Agent, or Firm* — Black, McCuskey, Souers & Arbaugh, LPA

(57) ABSTRACT

A device for at least one of inputting or outputting one or a plurality of security documents includes a security container for keeping available the documents, a first input/output interface and a second input/output interface, and a head unit which is mounted so as to be displaceable to a plurality of positions relative to the container. The head unit is configured to, in a first position of the plurality of positions, by means of the first input/output interface, transfer one or a plurality of security documents into or out of the device, in a second position of the plurality of positions, by means of the second input/output interface, transfer one or a plurality of security documents into or out of the device, and, in a third position of the plurality of positions, transfer one or a plurality of security documents between the head unit and the container.

15 Claims, 15 Drawing Sheets

(51) Int. Cl.

| | |
|---|---|
| ***G07D 11/40*** | (2019.01) |
| ***G07D 11/125*** | (2019.01) |
| ***G07D 11/165*** | (2019.01) |
| ***G07D 11/14*** | (2019.01) |

(52) U.S. Cl.
CPC ..... *G07D 11/40* (2019.01); *G07F 19/20* (2013.01); *G07F 19/205* (2013.01)

(58) Field of Classification Search
USPC ..... 235/379, 375, 487; 705/35–45
See application file for complete search history.

(56) References Cited

U.S. PATENT DOCUMENTS

| | | | | |
|---|---|---|---|---|
| 2010/0114769 | A1* | 5/2010 | Carpenter | B65H 3/00 705/43 |
| 2013/0140756 | A1* | 6/2013 | Kim | B65H 3/06 271/9.08 |

* cited by examiner

DEVICE, ASSEMBLY, AND METHOD FOR INPUTTING AND/OR OUTPUTTING ONE OR A PLURALITY OF SECURITY DOCUMENTS

CROSS-REFERENCE TO RELATED APPLICATION

This application claims priority to European Patent Application Serial No. 17 162 051.1, which was filed Mar. 21, 2017, and is incorporated herein by reference in its entirety.

TECHNICAL FIELD

Various embodiments relate to a device, to an assembly, and to a method for inputting and/or outputting one or a plurality of security documents.

BACKGROUND

In general, there is a need in the economy for cycles of various types in which security documents such as, for example, cash, circulate, change owners, and/or are temporarily stored. Most of these cycles require a financial institute as an intermediary, which withdraws cash from a cycle and re-supplies said cash according to fixed rules, thus functioning as a cash reservoir.

For example, department stores accept more cash than they spend, which is why the accrued excess of cash is conventionally transported to a financial institute (for example, to a bank) so as to securely store the profit. The cash temporarily stored at said financial institute by way of automatic tellers of the financial institute is then fed back into the cycle in that said cash is dispensed to customers of the financial institute. In order to facilitate the access of users to the automatic tellers, the latter are often disposed not only at the financial institute per se but also at locations, for example at a distance from the financial institute, where many potential customers assemble. Therefore, the cash in this part of the cycle has to be transported from the financial institute to the automatic tellers.

A significant effort is conventionally invested in order for the transport of the security documents to be protected against unauthorized access by third parties in the various parts of the cycle. For example, the frequency of the transports is increased in order to reduce the value per transport, and in order for said transport to be rendered unattractive. Alternatively or additionally, high levels of security measures are taken in order to avert any access by third parties.

SUMMARY

In various embodiments, a device for at least one of inputting or outputting one or a plurality of security documents is provided. The device includes a security container for keeping available one or a plurality of security documents, a first input/output interface and a second input/output interface, and a head unit, which is mounted so as to be displaceable to a plurality of positions relative to the security container. The head unit is configured to, in a first position of the plurality of positions, by means of the first input/output interface, transfer one or a plurality of security documents into or out of the device, in a second position of the plurality of positions, by means of the second input/output interface, transfer one or a plurality of security documents into or out of the device, and, in a third position of the plurality of positions, transfer one or a plurality of security documents between the head unit and the security container.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1A:
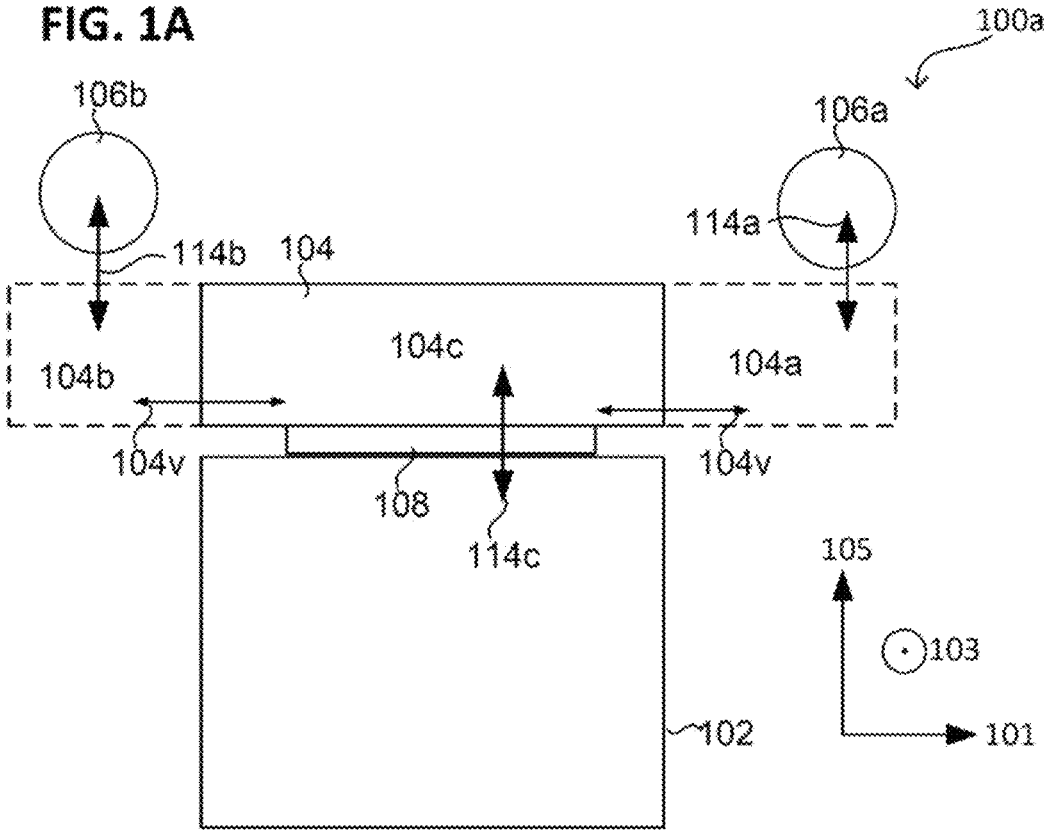
FIGS. 1A, 2A, and 3A show in each case a device according to the various embodiments in a schematic cross-sectional view or a lateral view.

The following detailed description refers to the accompanying drawings that show, by way of illustration, specific details and embodiments in which the invention may be practiced.

In the following detailed description, reference is made to the accompanying drawings, which form part of this description and show for illustration purposes specific embodiments in which the invention can be implemented. In this regard, direction terminology such as, for instance, "at the top", "at the bottom", "at the front", "at the back", "front", "rear", etc. is used with respect to the orientation of the figure(s) described. Since component parts of embodiments can be positioned in a number of different orientations, the direction terminology serves for illustration and is not restrictive in any way whatsoever. It goes without saying that other embodiments can be used and structural or logical changes can be made, without departing from the scope of protection of the present invention. It goes without saying that the features of the various embodiments described herein can be combined with one another, unless specifically indicated otherwise. Therefore, the following detailed description should not be interpreted in a restrictive sense, and the scope of protection of the present invention is defined by the appended claims.

In the context of this description, the terms "connected" and "coupled" are used to describe both a direct and an indirect connection (for example, a resistive and/or electrically conductive, for example an electrically conductive connection) and a direct or indirect coupling. In the figures, identical or similar elements are provided with identical reference signs, insofar as this is expedient. A coupling can be understood to be a mechanical coupling.

According to various embodiments, a device may include an automatic teller (also referred to as an automated teller machine (ATM), cash machine, cashpoint), or can be formed by such an automatic teller. The automatic teller can be understood to be a technical apparatus for withdrawing cash by self-service (also referred to as an automatic withdrawal machine), for example from a digital giro or credit card account, said withdrawal being performed, for example, by means of a debit card system. Alternatively or additionally, the automatic teller can also be specified for inputting cash by self-service (also referred to as an automated inputting machine), for example to a digital giro or credit card account, said deposit being performed, for example, by means of the debit card system. For example, the automatic teller can also be specified so as to be combined for withdrawing cash and for inputting cash (in more general terms also referred to as a transfer).

Alternatively or additionally to cash, the automatic teller can also be specified for outputting and/or receiving other security documents (for example, transferable, uniform and countable security documents) such as, for example, securities, checks, remittance documents, vouchers, postage stamp sheets, etc.

In general, an effect of various embodiments can be seen in that an escrow function (in other words, a fiduciary function) and thus an unequivocal point in time of the legally binding accounting of deposits or disbursals, respectively, to/from the two interfaces as will be yet explained in more detail hereunder, to/from the security container (for example to/from safe) is provided in a very simple manner. This can be provided in the so-called retail sector, for example in department stores, supermarkets, and the like. This is derived from the fact that security documents are always deposited by way of the same physical interface. A secure transfer of ownership between the party inputting the security document (for example, a trader) and the party receiving the security document in the security container (for example, a bank) is provided in this way.

According to various embodiments, an automatic teller is provided which, for example, on a safe (also referred to as a strongbox) includes a planar, displaceable head unit assembled thereon. This head unit may include a small installation height (for example, be plate-shaped) and have an operating region.

The operating region may include one or a plurality of keypads. The illustration of a keypad (also referred to as a keyboard pad) and of functional symbols (for example, in selection fields) can optionally be performed by means of a screen or else by means of imprinting respective operating information (for example, numerals, letters, symbols, or the like), and alternatively by means of a projection method.

FIG. 1A visualizes a device 100*a* according to various embodiments in a schematic cross-sectional view or a lateral view. According to various embodiments, the device 100*a* can be specified for inputting and/or outputting of at least one (that is to say precisely one or more than one) security document.

The device 100*a* may include a security container 102 (for example, an armored strongbox or another container that is protected from unauthorized access), a first (physical) input/output interface 106*a*, and a second (physical) input/output interface 106*b*, and a head unit 104. At least the second input/output interface 106*b* can be disposed so as to be spaced apart from the head unit 104, for example so as to be locationally fixed relative to the security container 102 and/or on a side of the head unit 104 that is opposite the security container 102.

The security container 102 can be specified for keeping available (for example, storing) the at least one security document, for example in the interior of said security container 102. For example, the security container 102 may include a plurality of regions 602*k* (cf. also FIG. 6), of which each region is assigned to one category (for example, based on the type and/or the value) of the at least one security document. A security document of one category can be stored and/or disposed in the region of the plurality of regions that is assigned to the category. Alternatively or additionally, the security container 102 may include a security housing which is, for example, of a multiple-wall design.

The head unit 104 can be mounted so as to be displaceable 104*v* (displaceable in a linear manner) between a plurality of positions, for example a first position 104*a*, a second position 104*b*, and a third position 104*c*, relative to the security container. To this end, the device 100*a* may include, for example, a bearing assembly 108 which couples the head unit 104 to the security container 102 and provides the head unit 104 with at least one degree of freedom 104*v*, for example a translatory degree of freedom 104*v*, relative to the security container 102.

The head unit 104 can be specified for in the first position 104*a*, by means of the first input/output interface 106*a*, transferring 114*a* the at least one security document, for example, in order to be received in the interior of the head unit 104 or to be dispensed from the interior of the head unit 104. The head unit 104 can furthermore be specified for, in the second position 104*b*, by means of the second input/output interface 106*b*, transferring 114*b* the at least one security document, for example, in order to be received in the interior of the head unit 104, or in order to be dispensed from the interior of the head unit 104. The head unit 104 can furthermore be specified for, in the third position 104*c*, transferring 114*c* the at least one security document between the head unit 104C and the security container 102, for example, in order to be received in the interior of the head unit 104, or in order to be dispensed from the interior of the head unit 104.

Figure 1B:
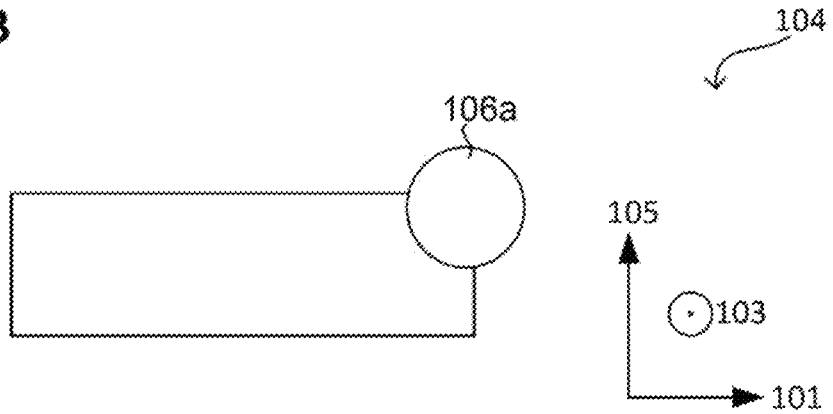
FIGS. 1B and 2B show in each case a head unit according to various embodiments in a schematic cross-sectional view or a lateral view.

FIG. 1B visualizes a head unit 104 according to various embodiments in a schematic cross-sectional view or a lateral view.

According to various embodiments, the head unit 104 may include the first input/output interface 106*a*, or the first input/output interface 106*a* can be at least disposed so as to be locationally fixed in relation to the head unit 104, for example be connected to the latter. For example, the first input/output interface 106*a* can be integrated in the head unit 104.

Figure 2A:
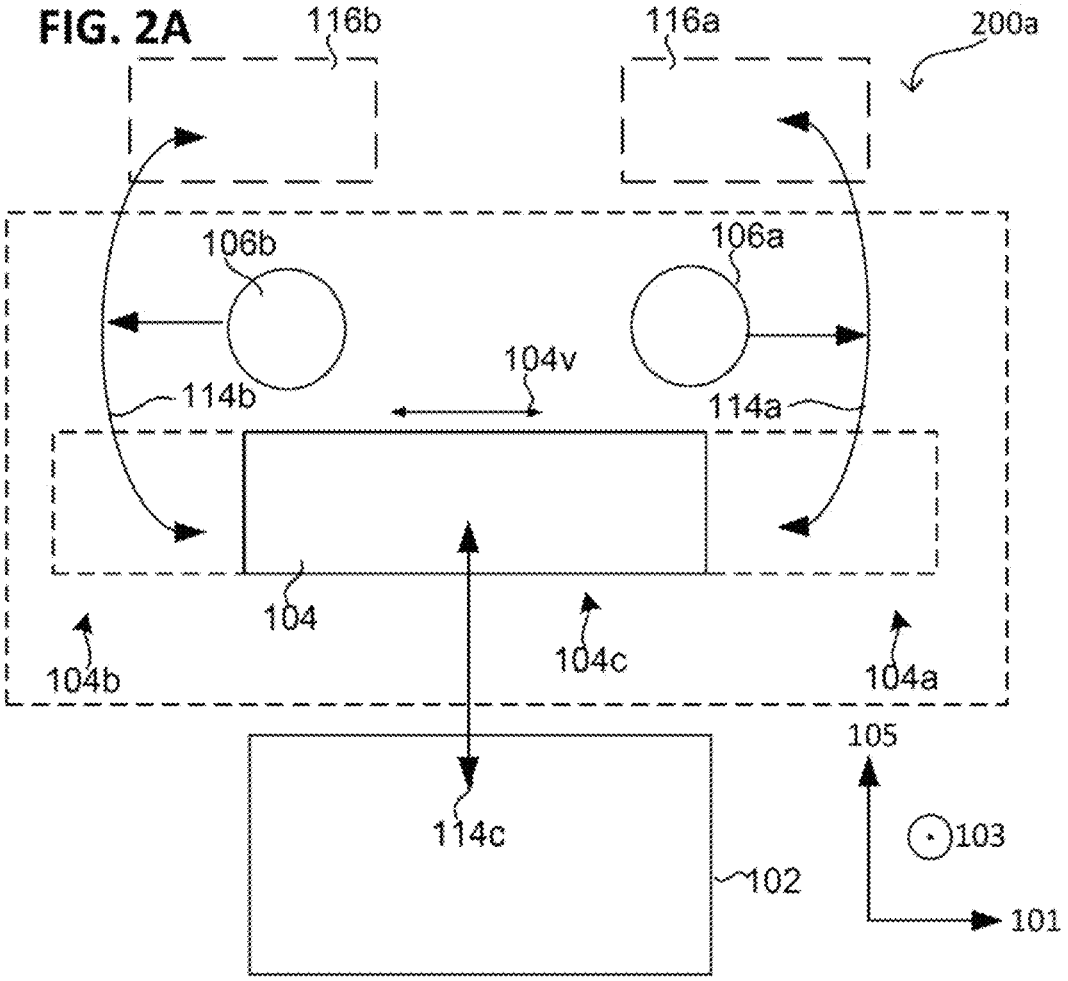

FIG. 2A visualizes a device 200*a* according to various embodiments in a schematic cross-sectional view or a lateral view. According to various embodiments, the device 200*a* can be specified for inputting and/or outputting at least one (that is to say precisely one or more than one) security document.

According to various embodiments, the device 200*a* may include the security container 102, a first inputting/outputting region 116*a*, and the second inputting/outputting region

116*b* (for example, disposed so as to be mutually spaced apart), and a transfer assembly 110.

The transfer assembly 110 can be specified for transferring the at least one security document along at least one transport path 114*a*, 114*b*, 114*c*. The transport paths 114*a*, 114*b*, 114*c* can be part of a transport path which extends into the device 200*a* and out of the latter.

The transfer assembly may include the head unit 104 which is mounted so as to be displaceable 104*v* to a plurality of positions 104*a*, 104*b*, 104*c* relative to the security container 102, said head unit 104, depending on the position thereof of the plurality of positions 104*a*, 104*b*, 104*c* providing the at least one transport path 114*a*, 114*b*, 114*c*.

The transfer assembly 110 can be specified for, in the first position 104*a* of the head unit 104, providing a first transport path 114*b* between the first inputting/outputting region 116*a* and the head unit 104 (for example, the interior of the latter). The transfer assembly 110 can furthermore be specified for, in the second position 114*b* of the head unit 104, providing a second transport path 114*b* between the second inputting/outputting region 116*b* and the head unit 104 (for example, the interior of the latter). The transfer assembly 110 can furthermore be specified for, in the third position 114*c* of the head unit 104, providing a third transport path 114*c* between the security container 102 (for example, the interior of the latter) and the head unit 104 (for example, the interior of the latter).

The device 200*a* can optionally be specified like the device 100*a*. For example, the transfer assembly 110 may include the first input/output interface 106*a* and/or the second input/output interface 106*b*.

The first transport path 114*a* and/or the first inputting/outputting region 116*a* can be provided, for example, by means of the first input/output interface 106*a*. For example, the first transport path 114*a* can extend into the first input/output interface 106*a*, or can be routed through the first input/output interface 106*a*.

The second transport path 114*a* and/or the second inputting/outputting region 116*b* can be provided, for example, by means of the second input/output interface 106*b*. For example, the second transport path 114*b* can extend into the second input/output interface 106*b*, or can be routed through the second input/output interface 106*b*.

Figure 2B:
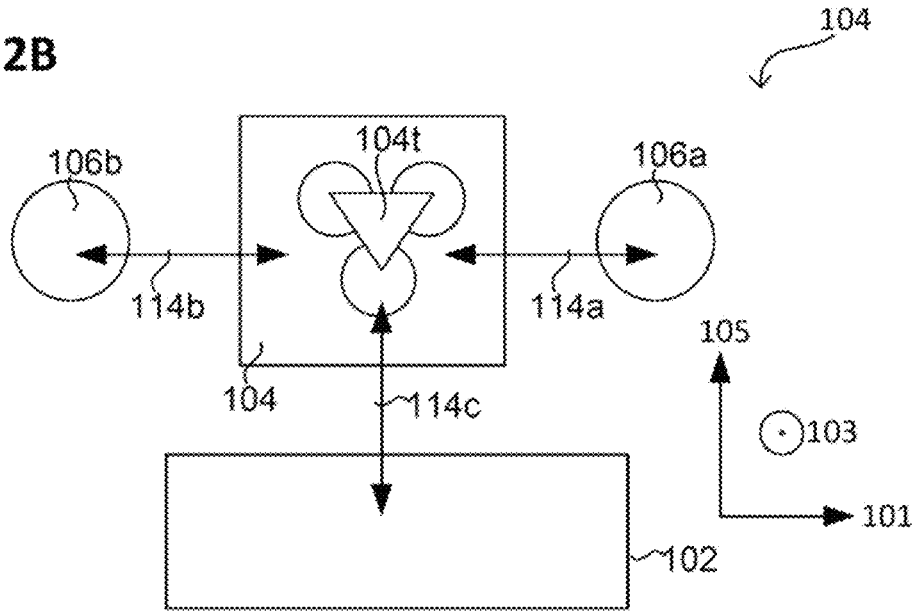

FIG. 2B visualizes a head unit 104 according to various embodiments in a schematic cross-sectional view or a lateral view.

According to various embodiments, the head unit 104 may include a transport device 104*t*. The transport device 104*t* may include a plurality of transport rollers by means of which the at least one security document can be transported. The transport device 104*t* can be disposed in the interior of the head unit 104. For example, the at least one security document that is disposed in the interior of the head unit 104 can be held and/or transported by means of the transport device 104*t*.

The head unit 104 can be specified for, in the first position 104*a* of the head unit 104, transferring the at least one security document between the first input/output interface 106*a* and the transport device 104*t*, for example along the first transport path 114*a*. For example, the transport device 104*t* can be specified for, in the first position 104*a* of the head unit 104, receiving the at least one security document from the first input/output interface 106*a*, or for dispensing said security document to the latter.

The head unit 104 can furthermore be specified for, in the second position 104*b*, transferring the at least one security document between the second input/output interface 106*b* and the transport device 104*t*, for example along the second transport path 114*b*. For example, the transport device 104*t* can be specified for, in the second position 104*b* of the head unit 104, receiving the at least one security document from the second input/output interface 106*b*, or for dispensing said security document to the latter.

The head unit 104 can optionally be specified for, in the third position 104*b*c, transferring the at least one security document between the security container 102 and the transport device 104*t*, for example along the third transport path 114*c*. For example, the transport device 104*t* can be specified for, in the third position 104*c* of the head unit 104, receiving the at least one security document from the security container 102, or for dispensing said security document to the latter.

Figure 3A:
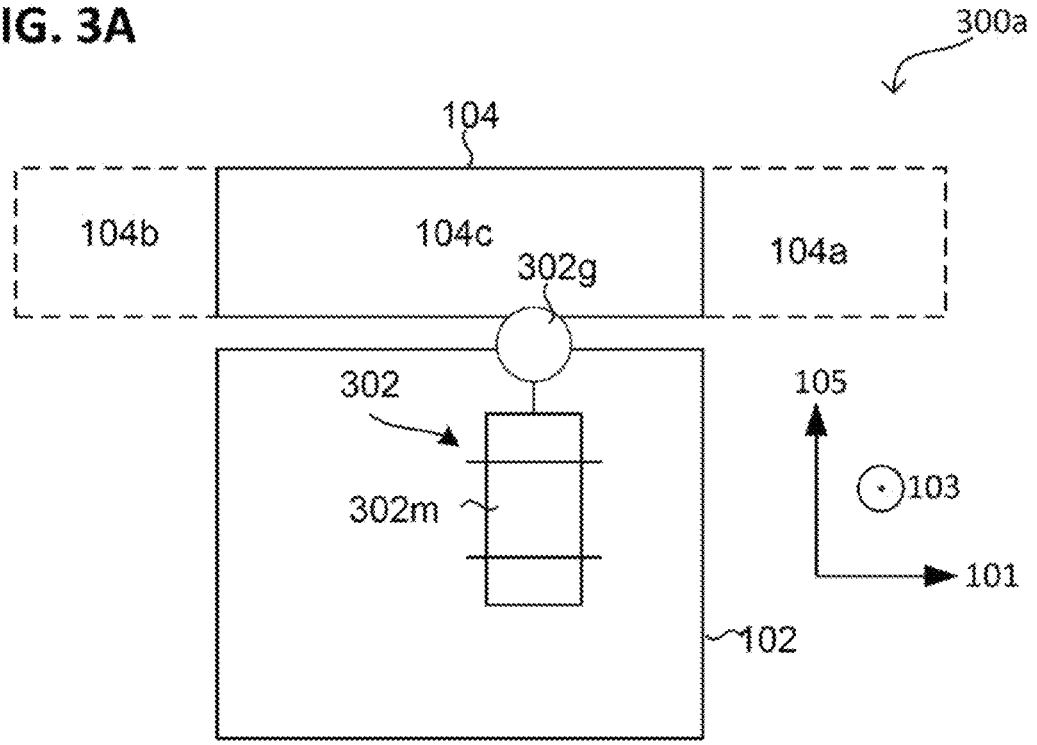

FIG. 3A visualizes a device 300*a* according to various embodiments in a schematic cross-sectional view or a lateral view. According to various embodiments, the device 300*a* can be specified like the device 100*a* or the device 200*a*, with the difference that the device 300*a* may furthermore include an electric drive 302 which is specified for driving the displacement of the head unit 104 between the plurality of positions 104*a*, 104*b*, 104*c*.

For example, the drive 302 may include an electric motor 302*m* (or generally an electromagnetic converter 302*m*) which can be specified for providing an interaction (for example, a thrust force) between the security container 102 and the head unit 104, for example for causing the displacement (that is to say a linear movement) between the plurality of positions 104*a*, 104*b*, 104*c* by means of the mechanical interaction.

For example, the drive 302 can be fastened to the security container 102 or be part of the latter, and be specified for transmitting the thrust force to the head unit 104. Alternatively, the drive 302 can be fastened to the head unit 104 or be part of the latter, and be specified for transmitting the thrust force to the security container 102.

For example, the drive 302 may include an electric motor 302*m* (also referred to as a torque motor) which can be specified for providing a torque. Alternatively or additionally, the drive 302 may include a gearbox 302*g* which can be specified for providing a thrust force (also referred to as a translatory force) for causing the displacement between the plurality of positions 104*a*, 14*b*, 104*c*. For example, the gearbox 302*g* can be coupled to the motor 302*m*, and/or be specified for converting the torque of the motor 302*m* to the thrust force (that is to say a translatory force). The torque motor 302 can be cost-effective in terms of procurement.

Alternatively, the drive 302 may include an electric linear motor 302*m* which can be specified for providing the thrust force. The linear motor 302*m* can be more compact.

Figure 3B:
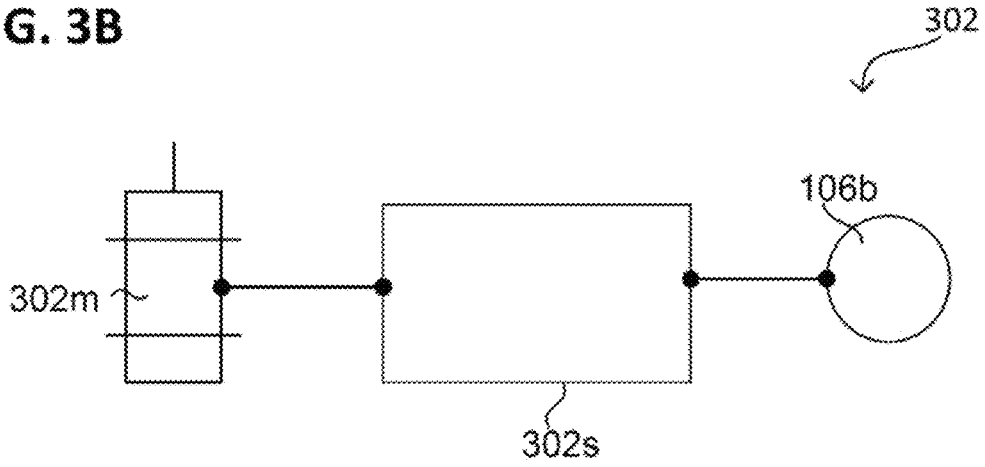
FIG. 3B shows a drive according to various embodiments in a schematic plugging diagram.

FIG. 3B visualizes a drive 302 according to various embodiments in a schematic plugging diagram.

According to various embodiments, the drive 302 may include a control device 302*s*, or can at least be coupled to the latter. For example, the control device 302*s* can be part of the drive 302. Alternatively, the control device 302*s* can actuate more than only the drive 302. For example, the control device 302*s* may include a first control switching circuit for actuating the electromagnetic converter 302*m*, and optionally at least one second control switching circuit which implements an operating function, for example conjointly with a user interface.

The control device 302*s* can be specified for actuating the electromagnetic converter 302*m* in such a manner that the head unit 104 is displaced to the first position 104*a* when the control device 302*s* receives a transfer request that is assigned to the first input/output interface; that the head unit 104 is displaced to the second position 104*b* when the control device 302*s* receives a transfer request that is assigned to the second input/output interface, and/or that the head unit 104 is displaced to the third position 104*c* when the control device 302*s* receives a transfer request that is assigned to the security container 102. For example, the or each transfer request may include an electrical signal which is transmitted to the control device 302*s*.

The transfer request that is assigned to the first input/output interface 106*a* can demonstrably represent a request for transferring the at least one security document to or from the first input/output interface 106*a*. The transfer request that is assigned to the second input/output interface 106*b* can demonstrably represent a request for transferring the at least one security document to or from the second input/output interface 106*b*. The transfer request that is assigned to the security container 102 can demonstrably represent a request for transferring the at least one security document in or out of the security container 102.

The transfer request that is assigned to the first input/output interface, for example, can be provided by the first input/output interface 106*a* and be transmitted to the control device 302*s*, or can be provided from a (for example, external) user interface and be transmitted to the control device 302*s*, for example optionally by way of the first input/output interface 106*a*. The transfer request that is assigned to the second input/output interface, for example, can be provided by the second input/output interface 106*b* and be transmitted to the control device 302*s*, or can be provided by a (for example, external) user interface and be transmitted to the control device 302*s*, for example optionally by way of the second input/output interface 106*b*.

The transfer request that is assigned to the security container 102 can be provided, for example, by the security container 102 or by the head unit 104 (for example, by the transport device 104*t* of the latter) and be transmitted to the control device 302*s*. For example, the transfer request that is assigned to the security container 102 can be provided by the head unit 104 when the at least one security document is disposed in the head unit 104 (for example, in the transport device 104*t* of the latter) or is to be transferred into said head unit 104 from the security container 102.

An input/output interface 106*a*, 106*b* (that is to say the first input/output interface 106*a* and/or the second input/output interface 106*b*) can provide the respective transfer request, for example, when the input/output interface 106*a*, 106*b* is (for example, mechanically) activated. For example, the input/output interface 106*a*, 106*b* can be activated in that the at least one security document is provided (for example, supplied) to the input/output interface 106*a*, 106*b*, and/or in that the at least one security document is disposed in the first inputting/outputting region 116*a*, or in the second inputting/outputting region 116*b*, respectively. Alternatively or additionally, the user interface can be activated in that an activation unit (for example a switch) of the user interface is activated.

For example, the at least one security document can be transferred on request by means of the user interface of the device (for example, when a user activates the user interface), for example transferred out of the security container 102 toward the first input/output interface 106*a* (in this instance, demonstrably a disbursal request).

For example, the external user interface can be disposed at a distance from the device, for example in an enterprise. For example, the at least one security document can be transferred on the request by means of the external user interface (for example, when a user activates the user interface), for example transferred from the enterprise toward the security container 102 by means of the second input/output interface 106*b* (in this instance, demonstrably a deposit request).

Figure 4A:
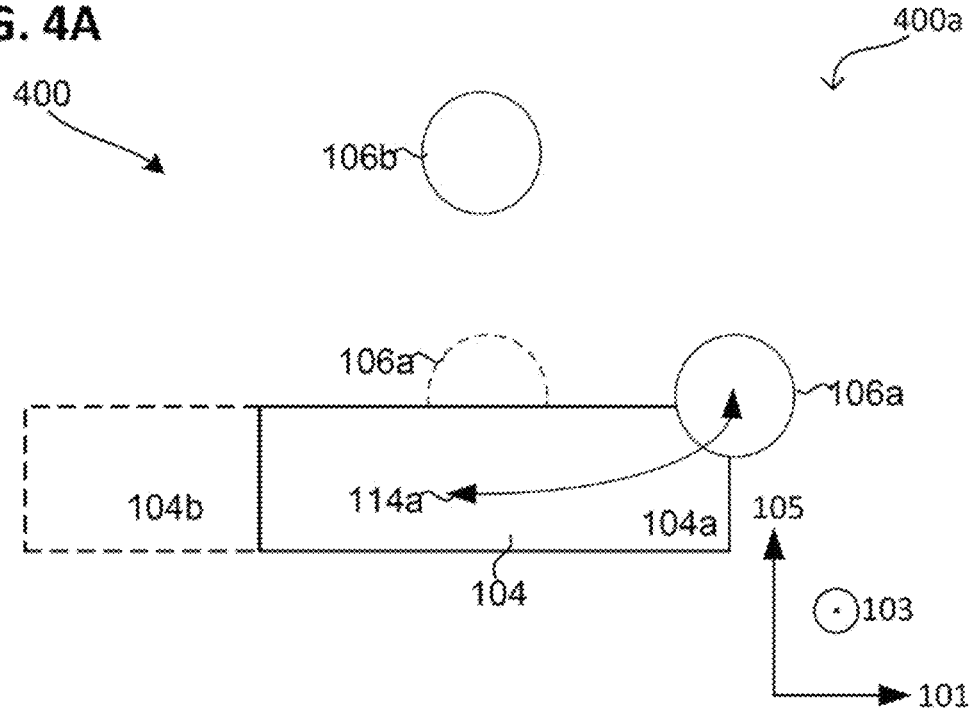
FIGS. 4A and 4B show a device according to various embodiments in various transfer configurations.
Figure 4B:
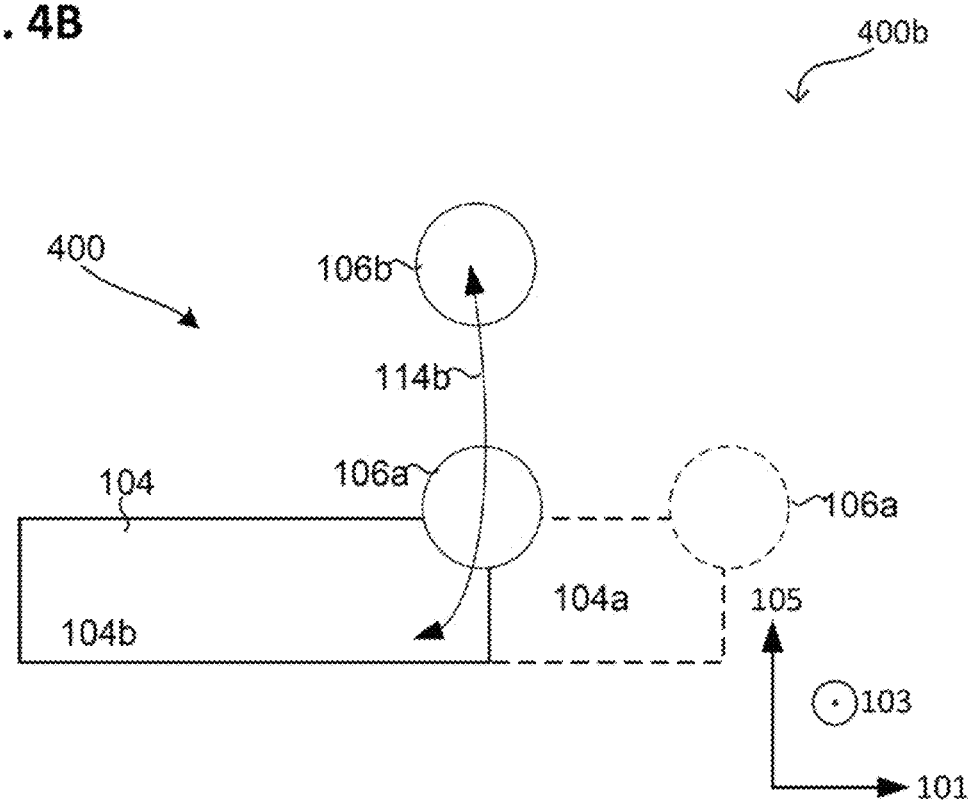

FIG. 4A and FIG. 4B visualize a device 400 according to various embodiments in a schematic cross-sectional view or a lateral view in various transfer configurations 400*a*, 400*b*. According to various embodiments, the device 400 can be specified like one of the devices 100*a*-300*a* described above, with the difference that the head unit 104 can furthermore be specified for, in the second position 104*b*, by means of the first input/output interface 106*a* as well as of the second input/output interface 106*b*, transferring (for example, receiving or dispensing) the at least one security document.

In a first transfer state 400*a*, the head unit 104 can have been moved or be moved to the first position 104*a*. The transfer of the at least one security document between the interior of the head unit 104 and the first input/output interface 106*a* can then be performed.

In a second transfer state 400*b*, the head unit 104 can have been moved or be moved to the second position 104*b*. The transfer of the at least one security document between the interior of the head unit 104 and the second input/output interface 10*b* can then be performed by way of (that is to say by means) of the first input/output interface 106*a*.

For example, the first input/output interface 106*a* can be specified for transferring the at least one security document between the second input/output interface 106*b* and the interior of the head unit when the head unit 104 is moved to the second position 104*b*. Alternatively or additionally, the first input/output interface 106*a* and the second input/output interface 106*b* can be mutually specified in such a manner that the at least one security document can be transferred therebetween (that is to say among said two input/output interfaces 106*a*, 106*b*) when the head unit 104 is in the second position. For example, the first input/output interface 106*a* can be closer to the second input/output interface 106*a* when the head unit 104 is in the second position 104*b* than when the head unit 104 is in the first position 104*a*.

Figure 5A:
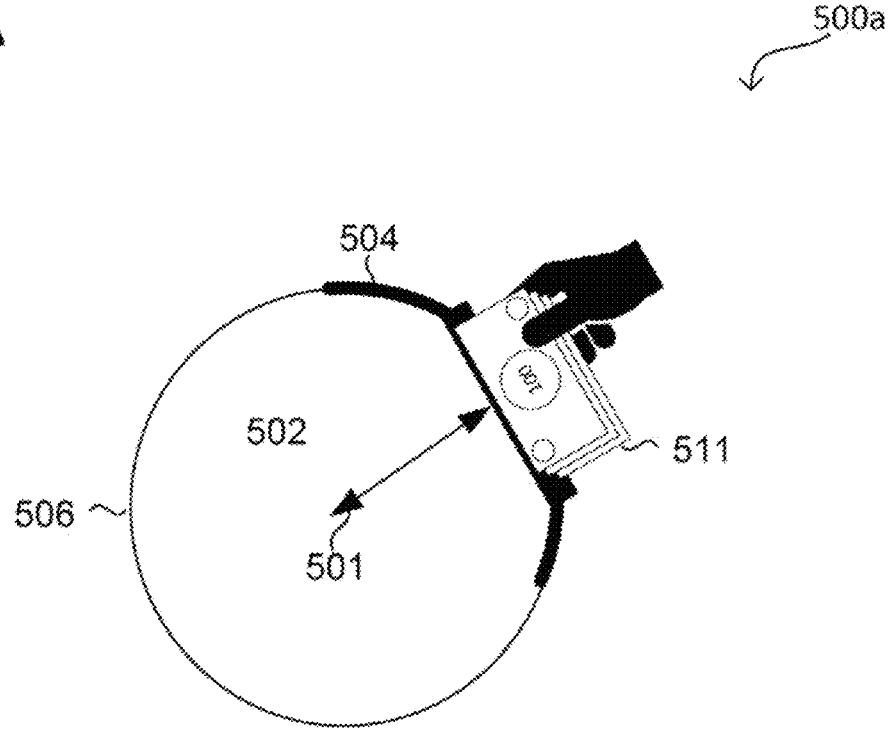
FIGS. 5A and 5B show in each case an input/output interface according to various embodiments in a schematic cross-sectional view or a lateral view.

FIG. 5A visualizes an input/output interface 500*a* (for example, the first input/output interface 106*a* and/or the second input/output interface 106*b*) according to various embodiments in a schematic cross-sectional view or a lateral view.

The input/output interface 500*a* may include a storage container 506 (including a cavity 502 which provides, for example, an inputting/outputting region 116*a*, 116*b*) in which the at least one security document 511 can be disposed and/or provided. Furthermore, the input/output interface 500*a* can have a closable opening 504 (also referred to as the transfer opening or the input/output opening), for example closable by means of a closure such as, for example a flap or a lid. The closable opening 504 can have been moved or be moved to an open state (that is to say when the closure is open) when the at least one security document 511 is to be transferred 501 by means of the input/output interface 500*a*, and otherwise can have been or be moved to a closed state (that is to say when the closure is closed). The closure of the closable opening 504 can be actuated, for example, by means of the control device 302*s*.

Figure 5B:
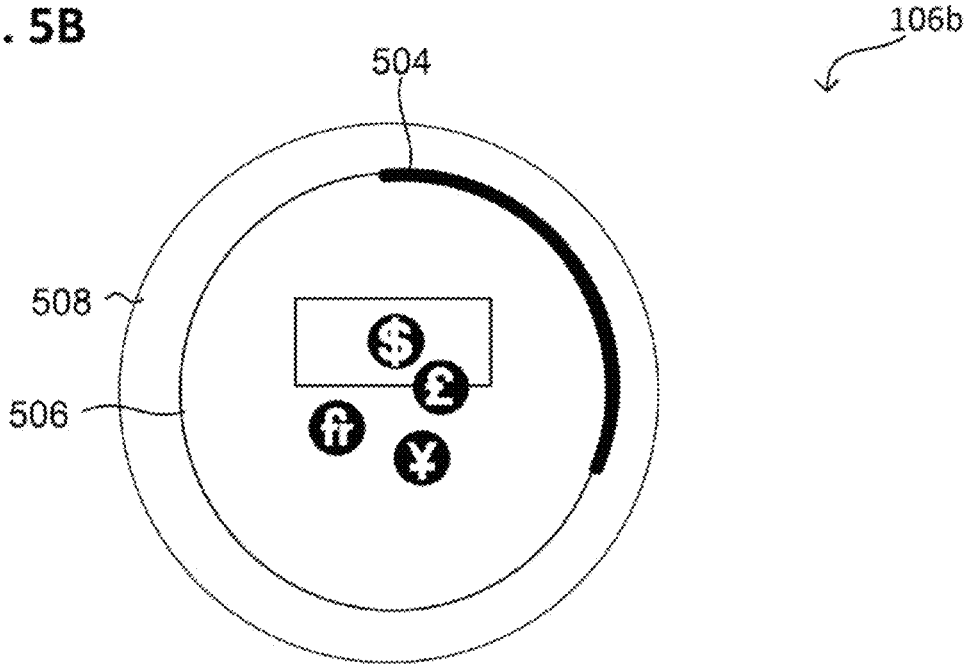

FIG. 5B visualizes an input/output interface 500*b* (for example, the first input/output interface 106*a* and/or the second input/output interface 106*b*) according to various embodiments in a schematic cross-sectional view or a lateral view.

According to various embodiments, the input/output interface 500*b* may include a container transport device 508 which is specified for transporting the storage container 506, for example, toward the head unit 104 and away from the latter. The opening 504 of the storage container 506 in this case does not necessarily have to be closable.

For example, the at least one security document 511 by means of the storage container 508 can be transported toward the head unit 104 before the at least one security document 511 is moved into the head unit 104 (for example, into the interior of the latter), for example when the at least one security document 511 is to be supplied to the device. Alternatively or additionally, the at least one security document 511 by means of the storage container 506 can be transported away from the head unit 104 once the at least one security document 511 has been moved out of the head unit 104 (for example, out of the interior of the latter), for example when the at least one security document 511 is to be retrieved from the device.

For example, the container transport device 508 may include a pipe system (for example, a pneumatic tube postal transport system) by means of which the storage container 506 can be transported, for example between an enterprise (for example, a retail business such as, for example, a supermarket or an outlet for electronics, or a furniture store, or the like) and the head unit 104.

Figure 6:
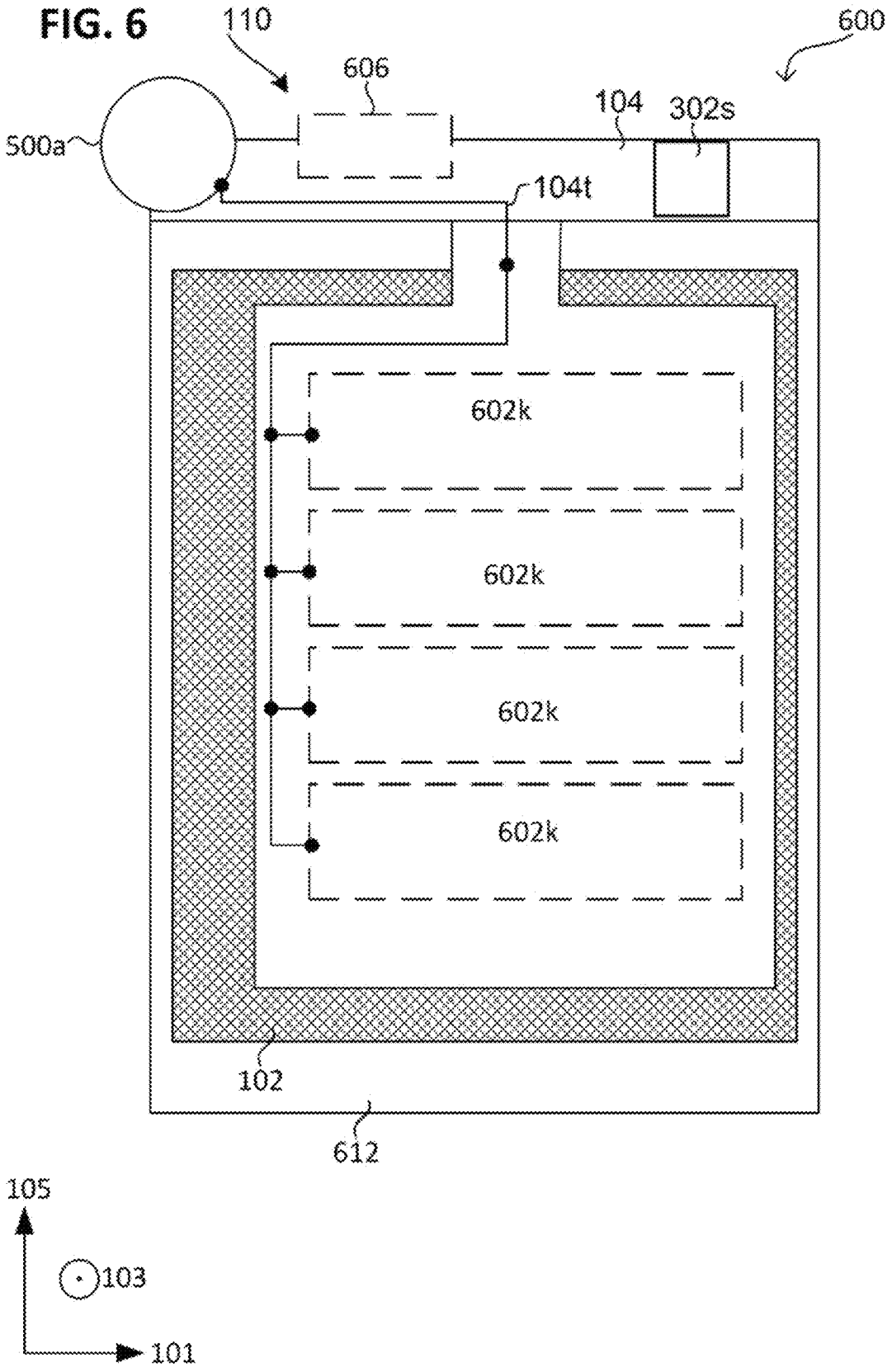
FIG. 6 shows a device according to various embodiments in a schematic cross-sectional view or a lateral view.

FIG. 6 visualizes a device 600 (for example, an automatic teller 600) according to various embodiments in a schematic cross-sectional view or a lateral view. According to various embodiments, the device 600 can be specified like one of the devices 100*a* to 400 described above.

The device 600 may include a security container 102. The at least one security document (for example, a payment instrument) that is deposited (for example paid in or kept on hand for dispersal) in the device 600 can be disposed and/or kept on hand in the security container 102. The security container 102 may, for example, include a strongbox (also referred to as a safe) or be formed therefrom and/or be armored.

The security container 102, depending on the security classification, may include a main body and at least one closable door, said main body and door being embodied by way of one or a plurality of walls, for example having a thickness of up to 20 cm. The main body walls may include steel (for example, one or a plurality of steel plates) and may additionally, depending on the protection required, include an insulating material, particles, plastics, concrete, or a combination thereof (for example, be filled therewith between two steel plates of a main body wall). The main body walls can be configured in a structure which impedes or renders an ineffective a burglary tool, for example by means of a concrete filling in which carborundum particles are embedded, or in which hardened steel pipes having a steel-ball filling are embedded. The main body may optionally include a flame-retardant material.

According to various embodiments, the security container 102 may include a plurality of cartridges 602*k* of which at least one security document, for example currency notes (bank bills) of a specific value or of a specific currency of a category (for example, a currency, a type, and/or a value) that is assigned to the cartridge 602*k* is or will be disposed in each cartridge 602*k*.

The device 600 may furthermore include a transfer assembly 110 for transferring at least one security document into the security container 102 or out of the latter. The transfer assembly 110 can optionally extend at least partially into the security container 102.

The transfer assembly 110 may include, for example, an input/output interface 500*a* (for example, the first input/output interface 106*a*) which is specified, for example, for singularizing and presenting the at least one security document. The transfer assembly 110 may furthermore include, for example, a transport device 104*t* which is specified for transporting the at least one security document within the device 600 (for example, in the head unit 104 and/or in the security container 102) for example for moving the at least one security document into the cartridge 602*k* or out of the latter.

The transport device 104*t* may optionally include a sorting device which is specified for categorizing the at least one security document and/or for sorting the individual cartridges 602*k*, for example based on the type and/or the value of said security document. The transport device 104*t* may optionally furthermore include an authentication device (for example, including one or a plurality of sensors) which is specified for identifying a fake (for example, a counterfeit) security document and for categorizing the latter as fake.

The device 600 may furthermore include a user interface 606 which includes at least one display device and an input device (for example, a keypad such as, for example, a keyboard and/or a numerical keypad) and/or a card reader.

Furthermore, the device 600 may include the control device 302*s* as described above. The control device 302*s* may include the second control switching circuit which, conjointly with the user interface 606, is specified for implementing an operating function. Alternatively or additionally, the control device 302 may include a third control switching circuit which, conjointly with the transport device 104*t*, is specified for controlling the transport of the at least one security document in the device, for controlling the sorting, and/or for rejecting at least one security document that has been categorized as fake.

The security container 102 can optionally be disposed in a housing 612 and/or be supported on a hard ground by means of a frame 612.

Figure 7A:
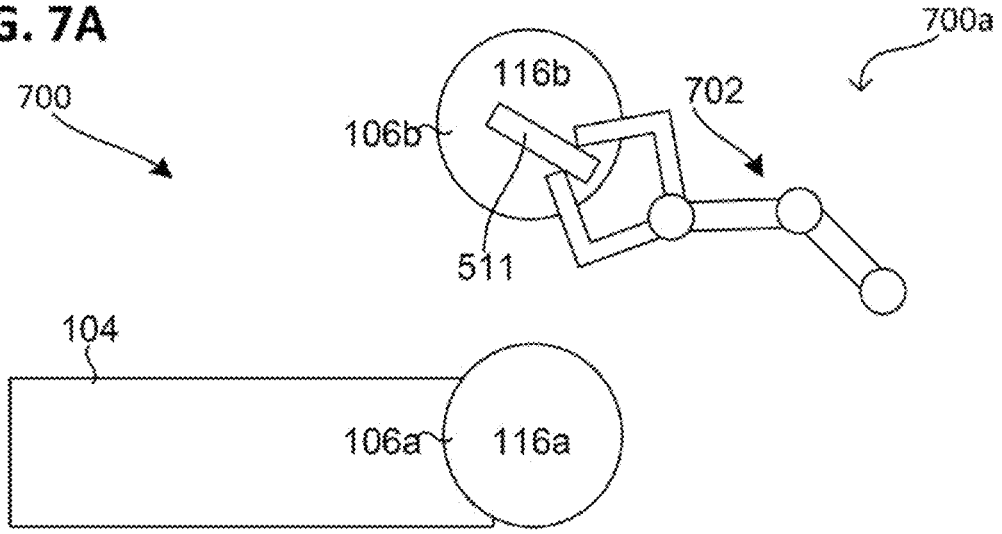
FIGS. 7A and 7B show a device according to various embodiments in various states of transfer.
Figure 7B:
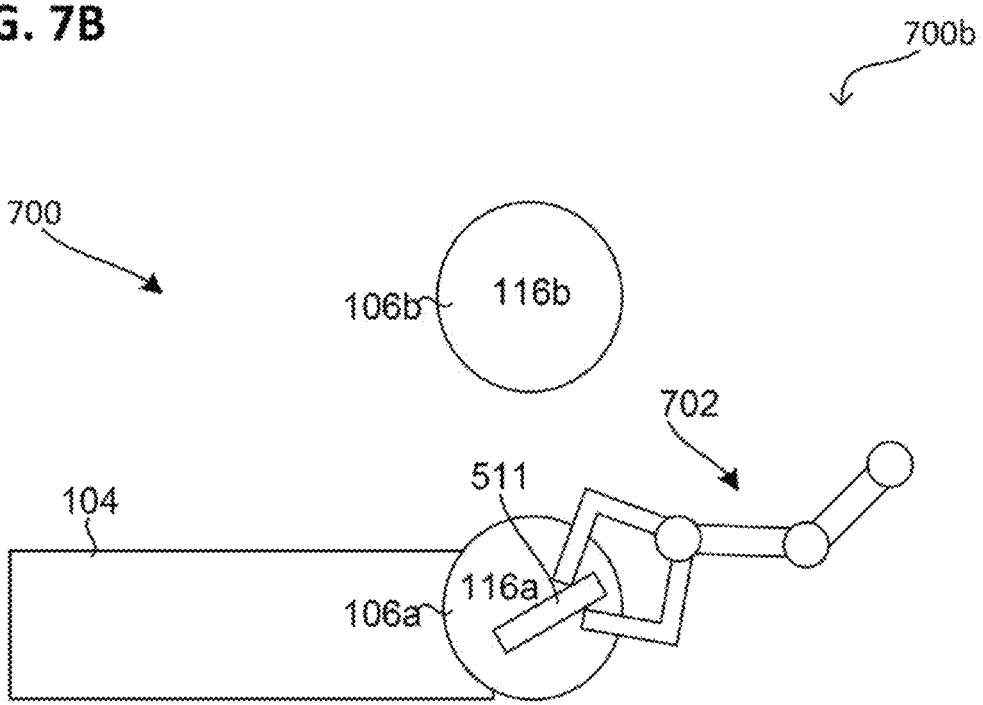

FIG. 7A and FIG. 7B visualize a device 700 according to various embodiments in a schematic cross-sectional view or a lateral view in various portions 700*a*, 700*b* of the transfer. According to various embodiments, the device 700 can be specified like one of the devices 100*a*-600 as described above, with the difference that the device 700*a* may include a manipulator 702 (also referred to as a handler), for example a robotic arm.

The at least one security document 511 in 700*a* can be disposed and/or provided in the second input/output interface 106*b*, for example in the storage container of the latter. The at least one security document 511 in 700*b* can be disposed and/or be provided in the first input/output interface 106*a*, for example in the storage container of the latter.

The manipulator 702 can be specified for transferring the at least one security document 511 (that is to say for the switchover between 700*a* and 700*b*). In other words, the manipulator 702 can be specified for transferring the at least one security document 511 between the interior 116*b* (for example, of the storage container) of the second input/output interface 106*b* and the head unit 104 (for example, the interior 116*a* of the first input/output interface 106*a*, for example the storage container of the latter).

For example, the at least one security document 511 by means of the storage container of the second input/output interface 106*b* can be transported across comparatively long distances toward the head unit 104 or away from the latter, for example toward an enterprise, for example to the check-out system thereof (for example, to a cash register system) or away from the latter.

For example, the at least one security document 511 by means of the manipulator 702 can be transported between the interior of the second input/output interface 106*b* and the head unit 104, for example, in that the at least one security document 511 by means of the manipulator 702 is transferred between the interior of the first input/output interface 106*a* and the interior of the second input/output interface 106*b*. The first input/output interface 106*a* can thereupon optionally be closed, and the at least one security document 511 can subsequently be transported within the device 700, for example into the security container 102 and/or by means of the transport device 104*t*.

The transport between the first input/output interface 106*a* and the security container 102 can be performed, for example, by means of the transport device 104*t*.

Figure 8:
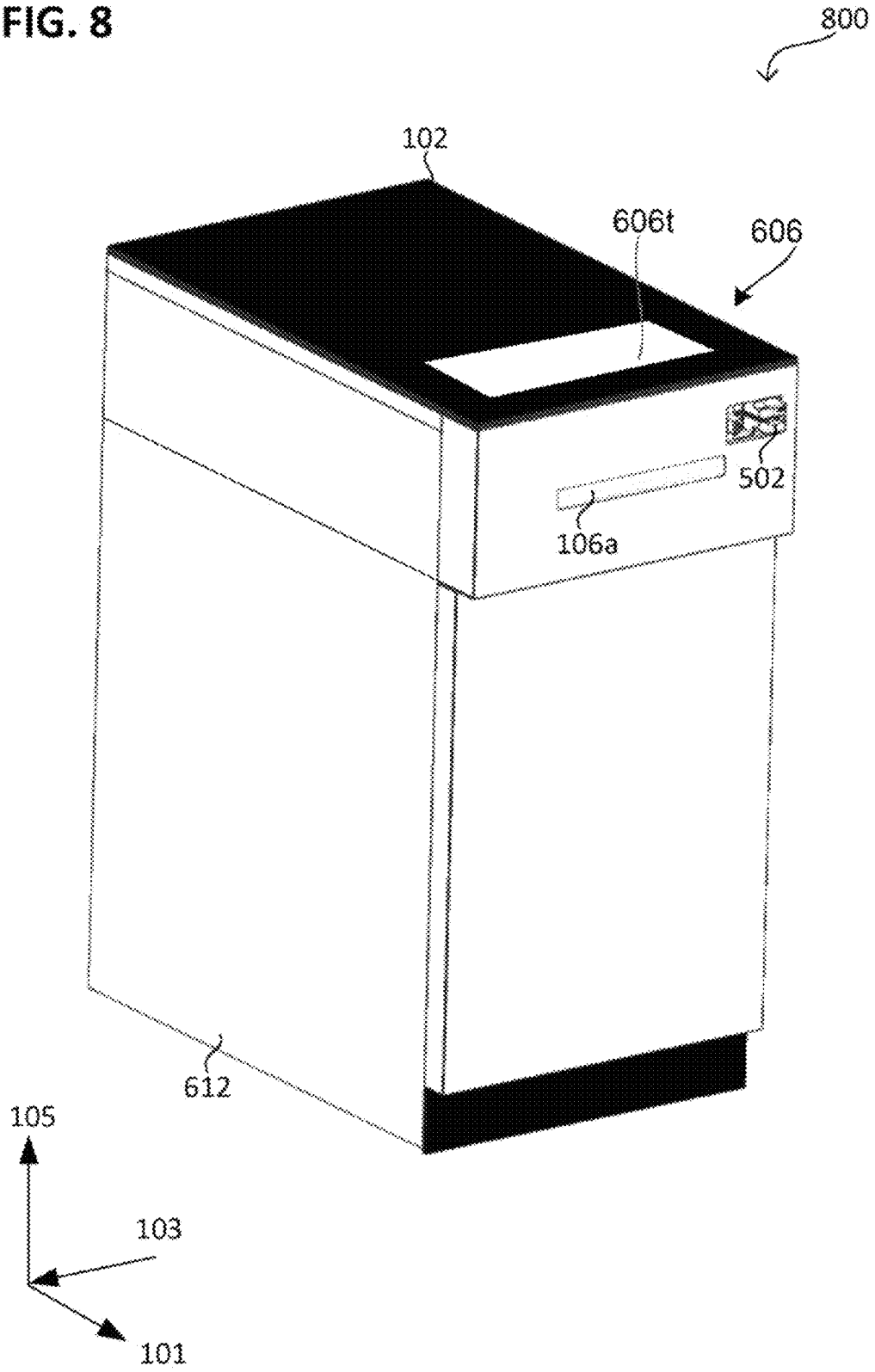
FIG. 8 shows a device according to various embodiments in a schematic perspective view.
Figure 9:
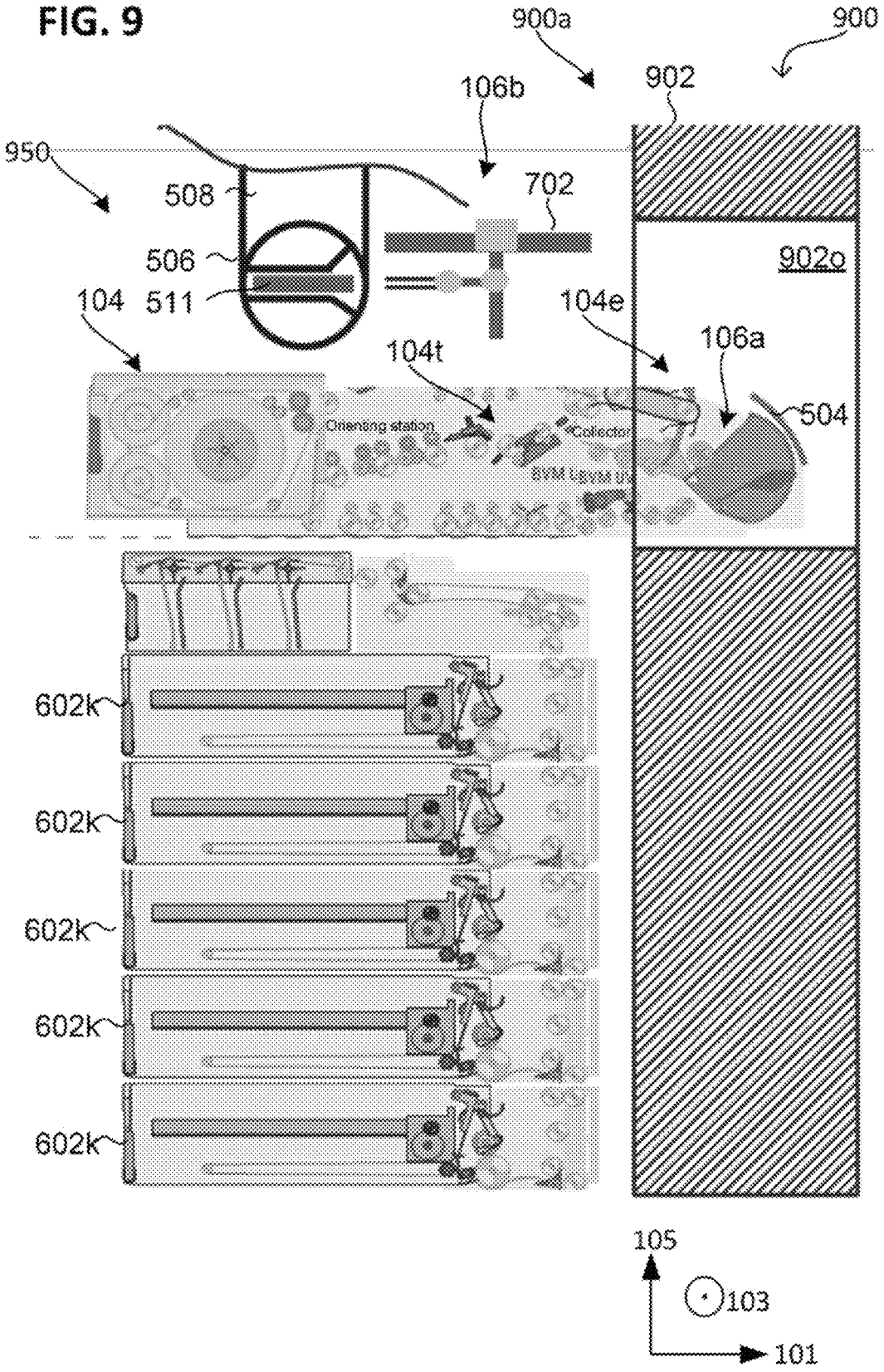
FIGS. 9 to 13 show in each case an assembly according to various embodiments in a schematic cross-sectional view or a lateral view.
Figure 10:
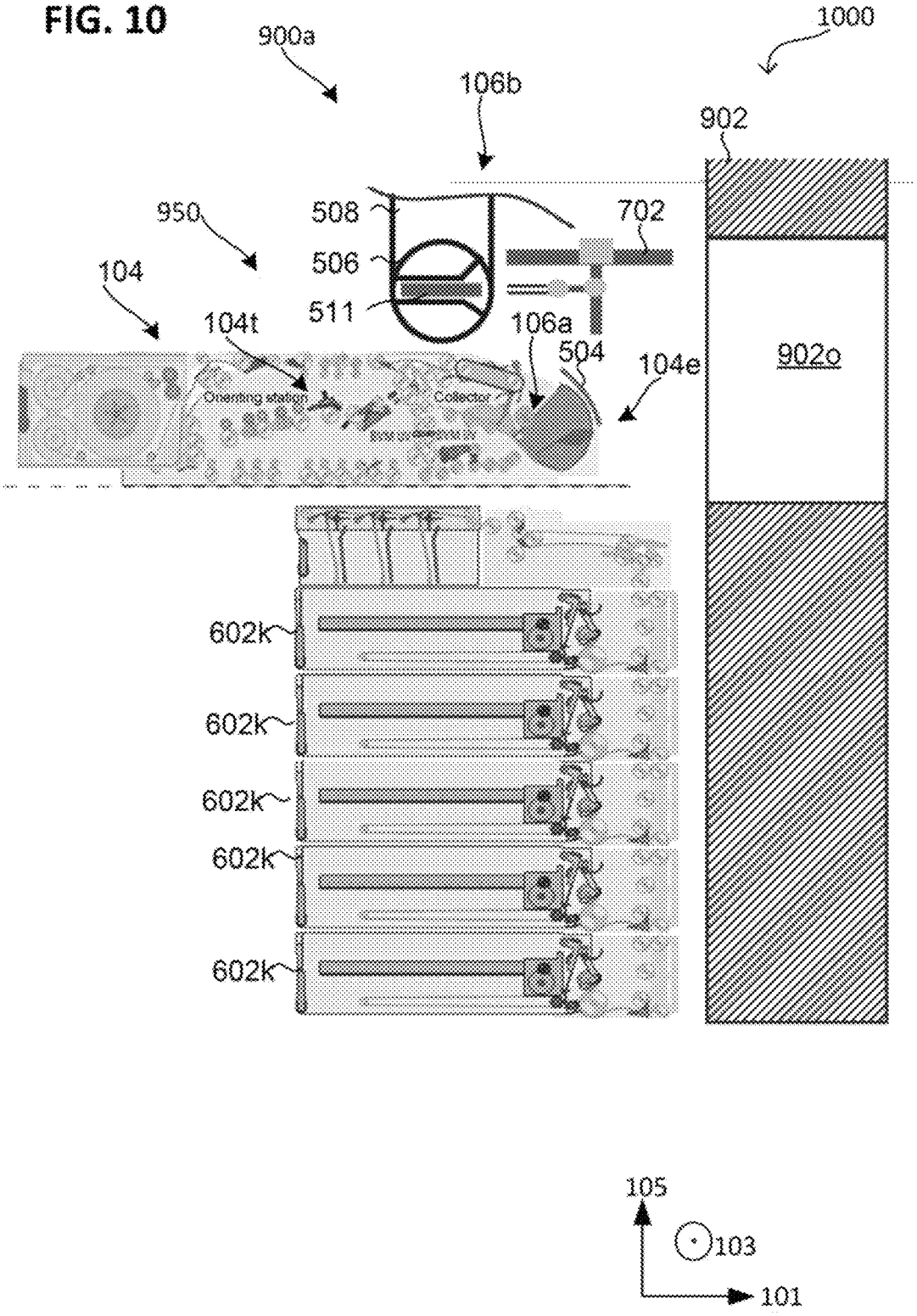
Figure 11:
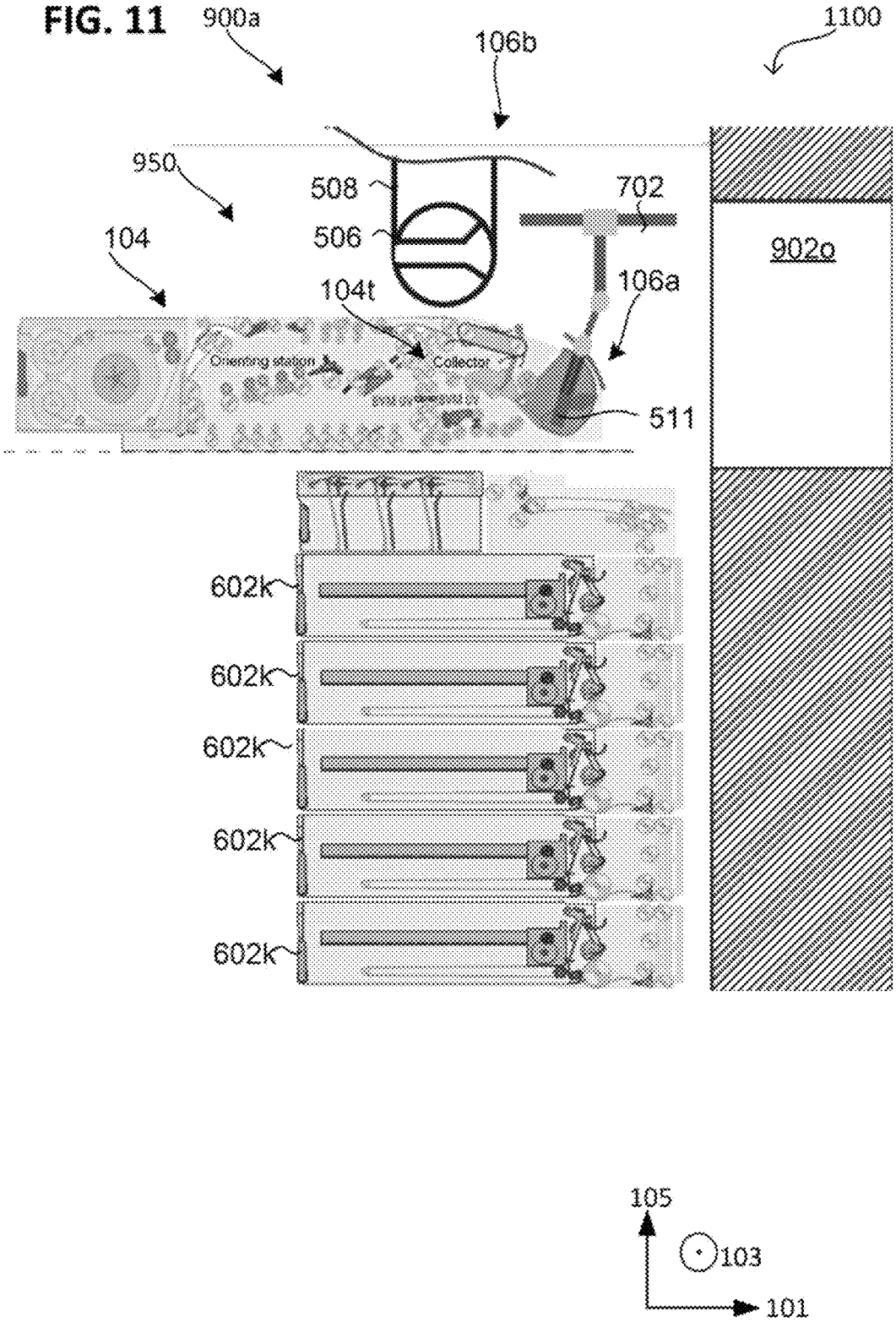
Figure 12:
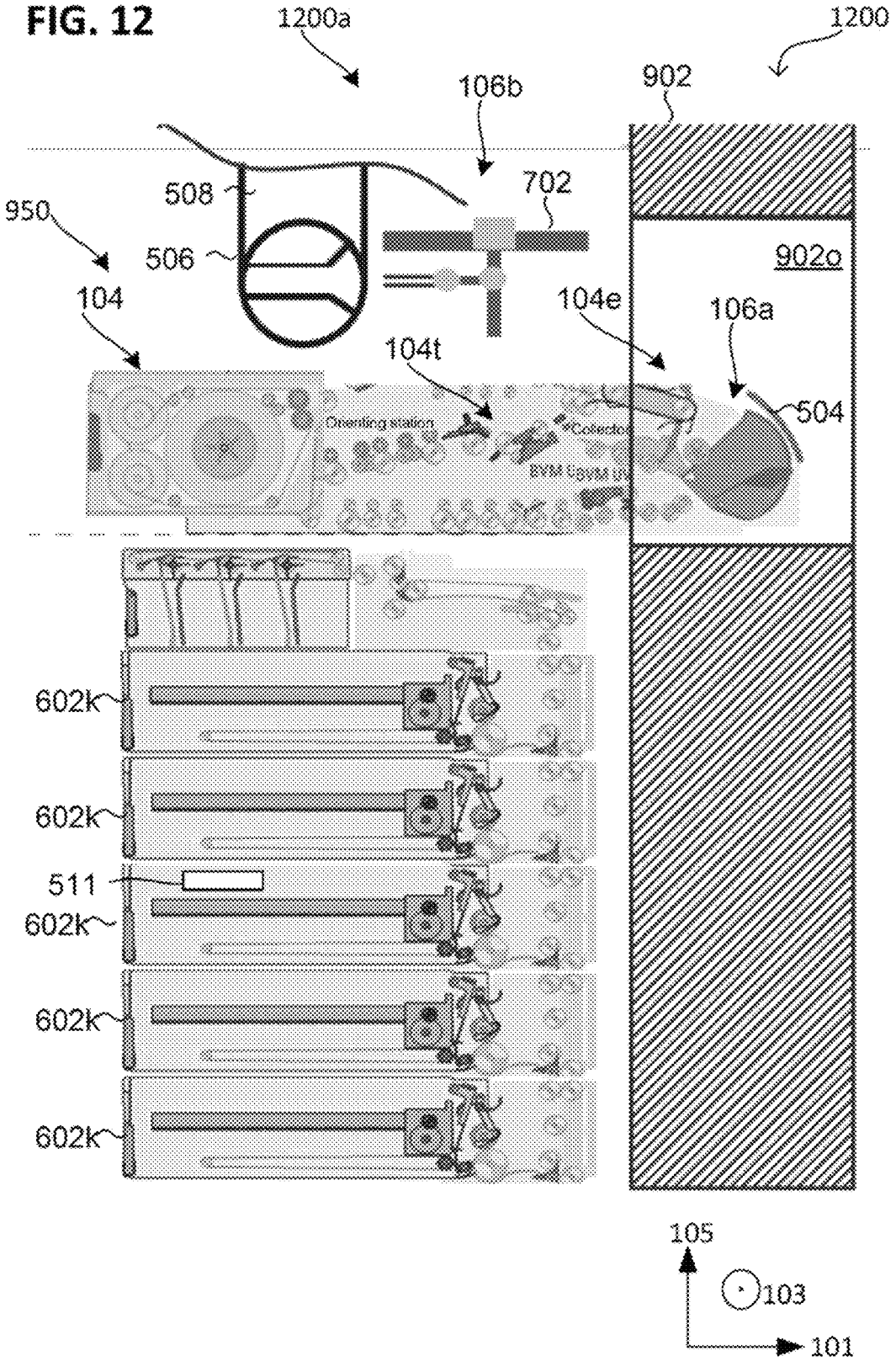
Figure 13:
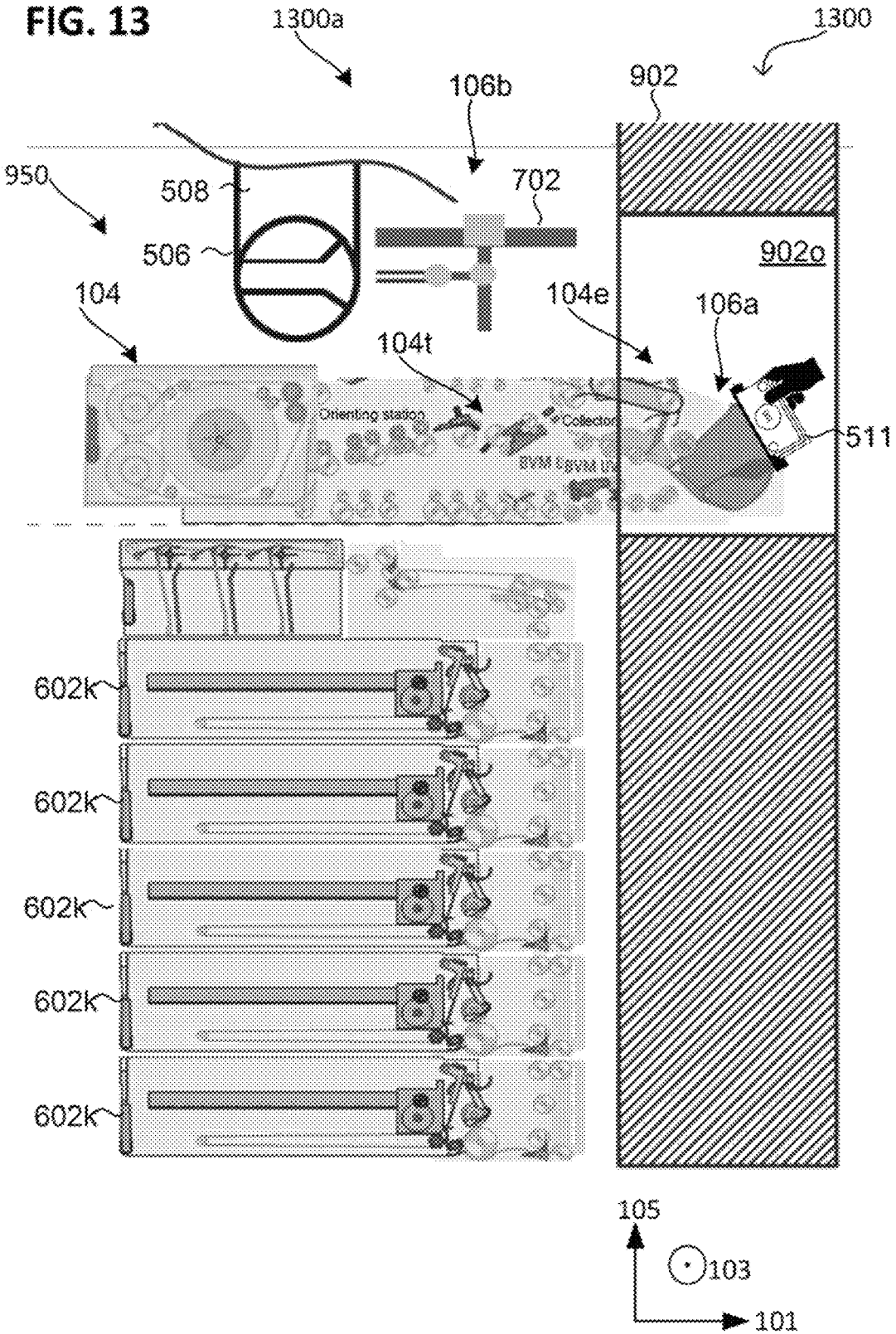

FIG. 8 visualizes a device 800 (for example, an automatic teller 800) according to various embodiments in a schematic perspective view.

According to various embodiments, the user interface 606 may include an input device 606*t* including a keypad, for example an encrypting PIN keypad (also referred to as an EPP unit). The operating function of the user interface 606 can provide, for example, an evaluation and/or encryption of an input (for example, of a personal identification number, a PIN, for authentication).

The input device 606*t* may furthermore include a card reader 502 which is specified for reading an identification card (also referred to as a service card, for example a smart card), for example a debit card, credit card, cash withdrawal card and/or cash card, that is supplied to said card reader 502. Alternatively or additionally, the input device 606*t* can have a near-field communication interface and/or a biometric sensor (for example, a finger print scanner) which can acquire and/or provide additional data for identification of the user.

FIG. 9, FIG. 10, FIG. 11, FIG. 12, and FIG. 13 visualize an assembly 900*a* according to various embodiments in a schematic cross-sectional view or a lateral view in a method. According to various embodiments, the assembly 900*a* may include one of the devices 950 which can be specified like one of the devices 100*a* to 800, for example a device 100*a*, 200*a*, 300*a*, 400, 600, 700, or 800.

The head unit 104 of the device 950 in 900, 1200, and 1300 can be in the first position 104*a*, and the head unit 104 of the device 950 in 1000 and 1100 can be in the second position 104*b* (cf. also FIG. 1A).

For example, the first position 104*a* can be identical to the third position 104*c*. This can facilitate the transfer and/or simplify the device 950. Alternatively, the first position 104*a* and the third position 104*c* can differ from one another. This can increase the level of security.

The assembly 900*a* may include a wall element 902 (including, for example, a construction material such as, for example, stone or concrete). The wall element 902 can, for example, be part of a (for example, supporting) building wall, or include the latter. Alternatively or additionally, the wall element 902 can, for example, be part of a (for example, non-structural) partition wall (including, for example, timber or plasterboard), or include the latter.

The wall element 902 may include a passage opening 902*o*, for example a breakthrough.

For example, the head unit 104 of the device 950 can have an end portion 104*e* which may include the first input/output interface 106*a*, as is visualized herein. In general, the first input/output interface 106*a* can also be disposed at any other place.

The first input/output interface 106*a* that is disposed on the end portion 104*e* enables that the head unit in a first position 104*a* by way of the first input/output interface 106*a* projects beyond the security container 102, and/or extends into the passage opening 902*o*. An operation of the device 950 from the side of the wall element 902 that is opposite the device 950 can thus be facilitated, and/or the unauthorized access to the device 950 can be impeded when said device 950 is not in the first position 104*a*.

The at least one security document 511 in 900 can be provided by means and/or in the second input/output interface 106*b*. This can release, for example, a transfer request that is assigned to one of the second input/output interfaces 106*b* and as a response causes the displacement of the head unit 104 to the second position (cf. FIG. 10). The at least one security document 511 in 900 can, for example, have been or be moved from an enterprise to the device 950, for example by means of the container transport device 508.

For example, the container transport device 508 may include a pipe system (for example, a pneumatic pipe postal transport system) by means of which a cylindrical storage container 506 can be transported, for example in pneumatically-operated manner. The storage container 506 can previously have been loaded, for example by hand, with the at least one security document 511 in the enterprise.

The head unit 104 in 1000 can have been or be moved to the second position 104*b*, for example as a response to the transfer request (which is assigned to the second input/output interface 106*b*). For example, the head unit 104 in 1000 can be moved from the first position 104*a* to the second position 104*b*.

The at least one security document 511 in 1100 can be transferred from the second input/output interface 106*b* to the first input/output interface 106*a*, for example by means of the manipulator 702. The transfer can be performed in an automated manner, for example. The transfer, for example, in 1100 may include: moving out (for example, retrieving) the at least one security document 511 from the second input/output interface 106*b* and moving in the at least one security document 511 into the first input/output interface 106*a*.

The at least one security document 511 in 1200 can have been or be moved from the first input/output interface 106*a* into the security container 102, for example by means of the transport device 104*t*. The at least one security document 511 herein can become the property of the operator of the device 950 (for example, of a financial institute).

The at least one security document 511 in 1300 can have been or be moved from the first security container 102 to the first input/output interface 106*a*, and be dispensed, for example to a user. The at least one security document 511 herein can become the property of the user.

Figure 14A:
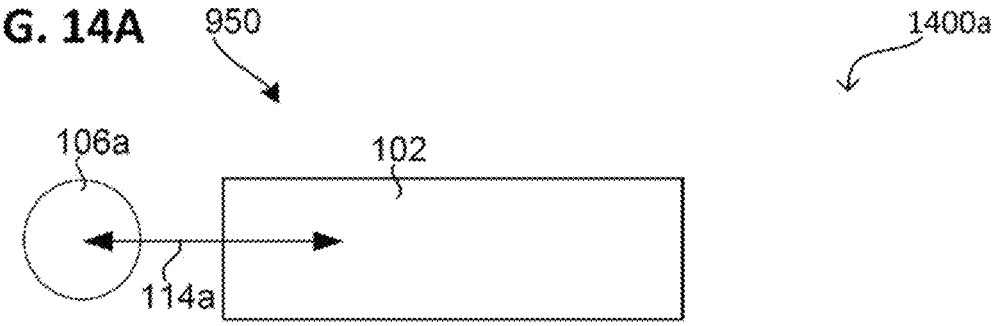
FIGS. 14A, 14B and 14C show in each case a device in a method.
Figure 14B:
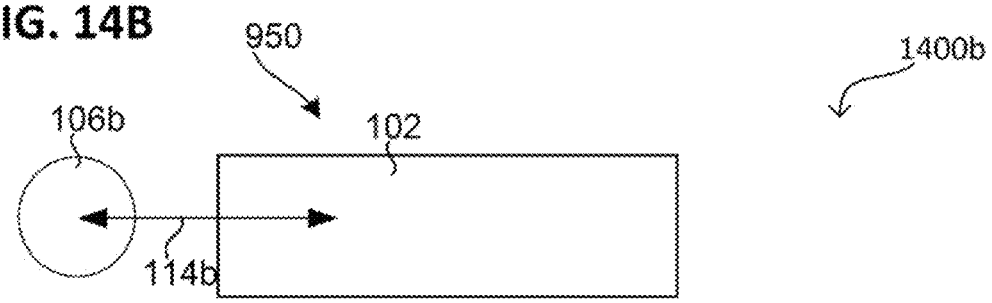
Figure 14C:
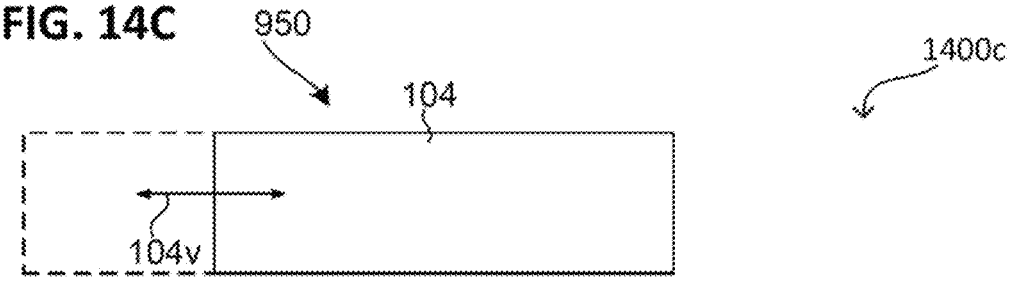
Figure 14C:
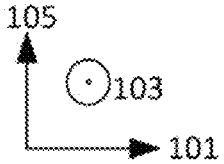

FIG. 14A, FIG. 14B, and FIG. 14C visualize a device 950 (including, for example, an automatic teller), for example the device 100, in a method, in a schematic lateral view or a cross-sectional view.

The method in 1400*a* and or 1400*b* may include the following: transferring 114*a*, 114*b* at least one security document between the security container 102 and at least one input/output interface of the device 100. The transfer 114*a* in 1400*a* can be performed between the security container 102 and the first input/output interface 106*a*. Alternatively or additionally, the transfer 114*b* in 1400*b* can be performed between the security container 102 and the second input/output interface 106*b*.

The method in 1400*c* may include the following: displacing the head unit 104 between at least two positions, for example from the first position 104*a* and/or to the second position 104*b*.

According to various embodiments, the head unit 104 in 1400*a* can have been or be moved to a first position 104*a* of the at least two positions. In the first position 104*a* of the head unit 104, the at least one security document in 1400*a* can be transferred 114*a* into the device 950 (or out of the latter) by means of the first input/output interface 106*a*.

Furthermore, the head unit 104 in 1400*a* can have been or be moved to a third position 104*c* of the at least two positions. For example, the head unit 104 in 1400*a* can remain in the first position 104*a*, for example when the third position 104*c* is identical to the first position 104*a*.

In the first position 104*a* and/or the third position 104*c* of the head unit 104, the at least one security document in 1400*a* can be transferred 114*a* into the security container 102 or out of the latter, for example by means of the transport device 104*t*.

According to various embodiments, the head unit 104 in 1400*b* can have been or be moved to a second position 104*b* of the at least two positions. In the second position 104*b* of the head unit 104, the at least one security document in 1400*b* can be transferred 114*b* out of the device 950 (or into the latter) by means of the second input/output interface 106*b* and optionally by means of the first input/output interface 106*a* (cf. also FIG. 4A and FIG. 4B, or FIG. 7A and FIG. 7B).

Furthermore, the head unit 104 in 1400*b* can have been or be moved to the third position 104*c* of the at least two positions. For example, the head unit 104 in 1400*b* can have been or be moved to the first position 104*a*, for example when the third position 104*c* is identical to the first position 104*a*.

In the first position 104*a* and/or the third position 104*c* of the head unit 104, the at least one security document in 1400*b* can be transferred 114*a* out of the security container 102 (or into the latter), for example by means of the transport device 104*t*.

Figure 15:
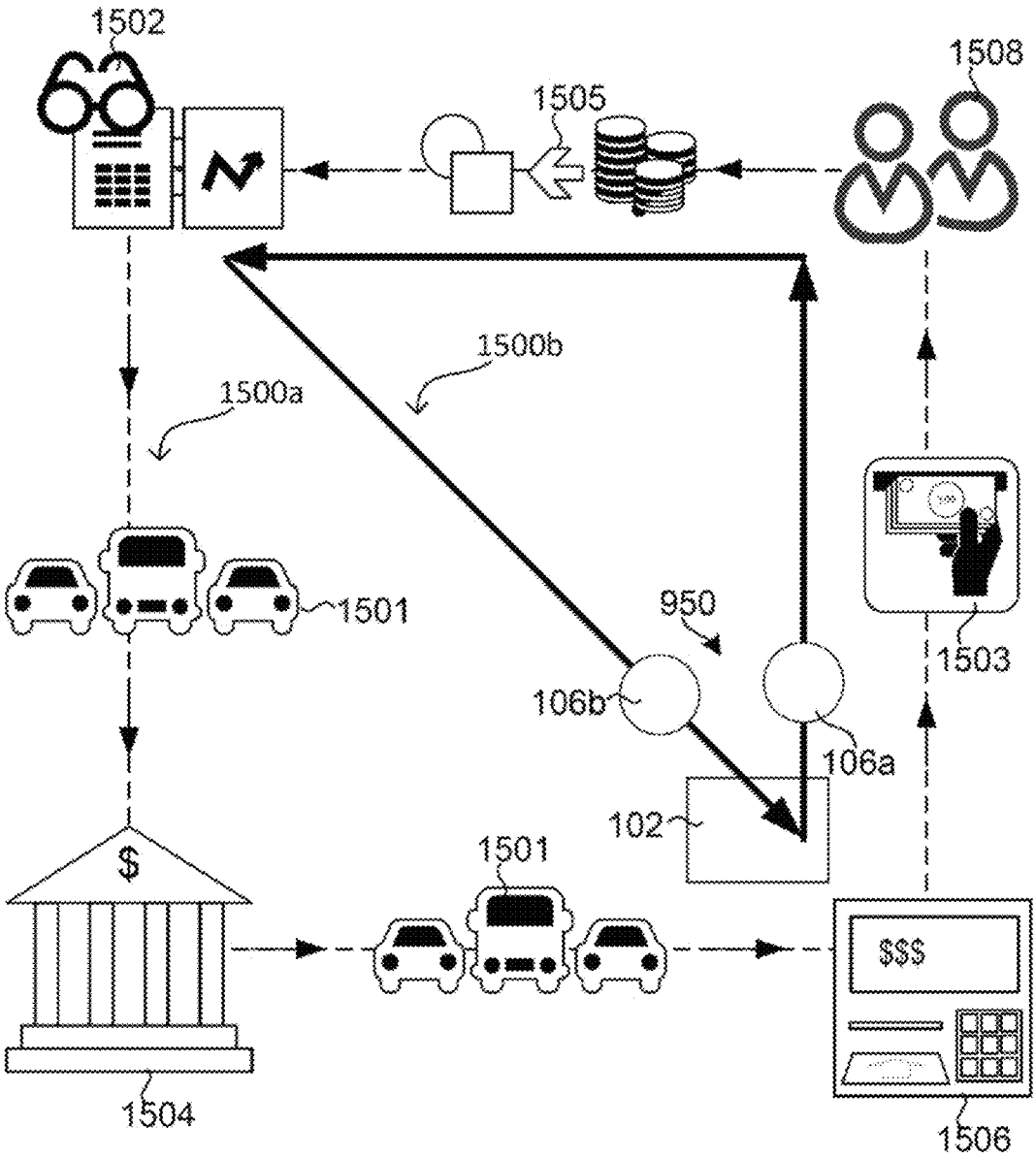
FIG. 15 shows a conventional security document cycle as compared to a security document cycle according to various embodiments.

FIG. 15 visualizes a conventional security document cycle 1500*a* and a security document cycle 1500*b* according to various embodiments in a schematic flow diagram.

Conventionally, the at least one security document, representing for example the profit of an enterprise 1502, in a security document cycle 1500*a* (dashed line) can be transported 1501 from the enterprise 1502 to a financial institute 1505, and herein become the property of the financial institute 1505. The financial institute 1505 by way of the at least one security document can supply 1501 the automatic tellers 1506 of said financial institute 1505, a user 1508 being able to demand 1503 (for example, withdraw) the at least one security document at said automatic tellers 1506, wherein the at least one security document herein becomes the property of the user 1508. The user 1508, by means of the at least one security document, can procure 1505 goods or services from the enterprise 1502, wherein the at least one security document herein again becomes the property of the enterprise 1502. This procedure can be performed in a cyclical manner, wherein the respective enterprise 1502 and/or the user 1508 can change.

According to various embodiments, a simplified security document cycle 1500*b* (solid line) can be provided, in that a device 950 (for example, one of the devices 100*a* to 800 described herein, for example the device 100*a*, 200*a*, 300*a*, 400, 600, 700 or 800) according to various embodiments is used for transferring the at least one security document. The enterprise 1502 can supply (that is to say transfer into the device 100) the at least one security document to the device 950 by means of the second input/output interface 106*b*, wherein the at least one security document herein becomes the property of the financial institute 1504, for example. The user 1506 can retrieve (that is to say transfer out of the device 100) the at least one security document from the device 100 by means of the first input/output interface 106*a*, wherein the at least one security document herein becomes the property of the user 1506. It is to be pointed out in this context that it is usually necessary for the process of counting of the input security documents to be carried out repeatedly. In various embodiments, this requirement can be almost entirely or even entirely dispensed with.

According to various embodiments, the security document cycle 1500*a* can be shortened, for example in that the transport branches 1501 of the security document cycle 1500*a* are saved. This saves effort, time and costs.

A physical separation between two branches of the security document cycle 1500*b* that incorporate the device 950 can have been or be demonstrably provided by means of the displacement of the head unit 104. This increases the security in relation to access by a third party. For example, the placing of the at least one security document into the device 100 by the enterprise 1502 can be performed in the background and thus be hidden from a user. Alternatively or additionally, the displaceable head unit can facilitate the conversion of already existing automatic tellers.

According to various embodiments, a device, an assembly, and a method which shorten some of the transport routes or render the latter unnecessary, respectively, and/or simplify some of the transports (cf. also FIG. 15) or make the latter more secure, are provided. It has been demonstrably recognized that security documents which are supplied to an automatic teller already within the automatic teller are assigned to the financial institute as property, or that the security documents kept on hand in the automatic teller are the property of the financial institute. It has been recognized in this context that the secured storage space of the automatic teller (for example a strongbox) in which the security documents kept on hand are stored can already be utilized as a cash reservoir.

For example, an enterprise (for example, the department store) can transport the accrued excess of cash to an automatic teller which is often closer than the nearest financial institute. The cash temporarily stored in said automatic teller becomes the property of the financial institute and can thus already be dispensed again from said automatic teller so as to be fed back into the cycle. The transport route to and from the financial institute can thus be saved. The more automatic tellers are available, the shorter the transport route from the enterprise. The transport from the enterprise to the automatic teller can optionally be facilitated in that a fixedly installed and/or automated transport system to an automatic teller in the vicinity or within the enterprise is used, said transport system, when installed in the building, for example, being protected against access by third parties.

According to various embodiments, a device for inputting and/or outputting one or a plurality of security documents may include the following: a security container for keeping available one or a plurality of security documents; a first input/output interface and a second input/output interface; a head unit which is mounted so as to be displaceable to a plurality of positions relative to the security container, wherein the head unit is specified for, in a first position (for example, an advanced position) of the plurality of positions, by means of the first input/output interface, transferring one or a plurality of security documents into (for example, into the interior of the head unit) or out of the device, in a second position (for example, a retracted position) of the plurality of positions, by means of the second input/output interface, transferring one or a plurality of security documents into (for example, into the interior of the head unit) or out of the device, and in a third position of the plurality of positions, transferring one or a plurality of security documents between the head unit (for example, the interior of the head unit) and the security container.

A physical separation between two branches of a security document cycle can be demonstrably provided or will be demonstrably provided by means of the displacement.

According to various embodiments, the head unit may include the first input/output interface, or the first input/output interface can at least be disposed so as to be locationally fixed in relation to the head unit.

According to various embodiments, the head unit and/or the first input/output interface can be disposed above the security container.

According to various embodiments, the head unit and the second input/output interface can be disposed so as to be mutually spaced apart. Alternatively or additionally, the second input/output interface can be disposed above and/or so as to be locationally fixed in relation to the security container.

According to various embodiments, the device can furthermore have: an electric drive which is specified for driving the displacement of the head unit between the plurality of positions.

According to various embodiments, the device may include a control device which is specified for displacing the head unit to the second position when the control device receives a transfer request (for example, from the enterprise) that is assigned to the second input/output interface. This facilitates an automated transfer.

According to various embodiments, an end portion of the head unit may include the first input/output interface; wherein the head unit in a first position, by way of the first input/output interface, projects beyond the security container. This enables enhanced security to be achieved.

According to various embodiments, the device can furthermore have a transport device, wherein the head unit is furthermore specified for in the first position transferring the security document or documents between the first input/output interface and the transport device; in the second position transferring the security document or documents between the second input/output interface and the transport device; and in the third position transferring the security document or documents between the security container and the transport device.

According to various embodiments, the head unit can furthermore be specified for in the second position transferring (for example, receiving or outputting) the security document or documents by means of the first input/output interface as well as of the second input/output interface.

According to various embodiments, the first input/output interface can be disposed between the second input/output interface and the security container when the head unit is in the second position.

According to various embodiments, the first input/output interface and the second input/output interface can be specified for transferring the security document or documents among one another (that is to say between one another) when the head unit is in the second position. This facilitates the conversion and/or enhances the security.

According to various embodiments, the second input/output interface may include a storage container (for example, a cartridge) and a manipulator; wherein the manipulator is specified for transferring the security document or documents between the storage container and the head unit (and/or the first input/output interface) when the head unit is in the second position. This facilitates the conversion.

According to various embodiments, the second input/output interface can furthermore have a container transport device which is specified for transporting the storage container to the manipulator and away from the latter. This facilitates the transfer between an enterprise and the device.

According to various embodiments, the first input/output interface may include a security document input module (also referred to as a cash recycling module), or can be formed by said security document input module. This further facilitates the conversion.

According to various embodiments, the second input/output interface can be disposed above the head unit and/or so as to be locationally fixed in relation to the security container. This facilitates the changeover between the transfer configurations.

According to various embodiments, the first position and the third position can be identical, and/or the first position and the second position can differ from one another.

According to various embodiments, the first inputting/outputting region and the second inputting/outputting region can be disposed so as to be mutually spaced apart. This improves the physical separation and thus enhances the security.

According to various embodiments, the input/output interface and the second input/output interface can be disposed so as to be mutually spaced apart.

According to various embodiments, the head unit may include at least one of the following: a display device; an input device (for example, a keypad such as, for example, a keyboard and/or a numerical keypad); and/or a card reader (for example, a smart card reader)

According to various embodiments, an assembly may include the following: a wall element (for example, a building wall and/or a partition wall) which includes a passage opening; a device according to various embodiments, wherein the head unit in the first position extends (demonstrably protrudes) into the passage opening or through the latter.

According to various embodiments, a method for operating a device, that is to say for inputting and/or outputting one or a plurality of security documents by means of the device (for inputting and/or outputting one or a plurality of security documents) which includes a security container, a head unit, a first input/output interface and a second input/output interface, may include the following steps: transferring one or a plurality of security documents between the security container and at least one (for example, the first and/or the second) input/output interface of the two input/output interfaces; and displacing the head unit between at least two positions, of which: in a first position, by means of the first input/output interface, the security document or documents are transferred into or out of the device (for example, an automatic teller); in a second position, by means of the second input/output interface, the security document or documents are transferred into or out of the device; and in a third position, the security document or documents are transferred between the head unit and the security container.

According to various embodiments, the or each security document may include, for example, cash such as a bank note and/or a coin, a check, a share certificate, a debenture, a bond, or any other (for example paper-based) security, or be formed thereof. Alternatively or additionally, the security document can be a payment instrument. A plurality of security documents can be specified, for example, as a package (that is to say as a combined unit), for example so as to be bundled (that is to say in the form of a bundle).

According to various embodiments, the security container and the head unit can be part of the automatic teller of the device or of another self-service terminal of the device.

According to various embodiments, the self-service terminal (for example, an automatic teller) may include the security container and the first input/output interface. The self-service terminal can be specified for providing various goods and services in an automated manner to a user, for example when the user requests said goods and services at the self-service terminal. For example, a self-service terminal can be an automatic teller where the user can personally deposit one or a plurality of securing documents or can withdraw the latter, and can undertake other bank transactions.

The goods (for example, security documents) can be kept on hand in a secured storage container (also referred to as the security container) of the self-service terminal, for example, in a strongbox (also referred to as a safe).

According to various embodiments, a self-service terminal (for example, an automatic teller) may include the following: a security container for keeping available (in other words receiving or storing) one or a plurality of security documents (for example, currency bills, coins, checks, or the like); a head unit for transferring payment instruments into and out of the security container; a user interface; and a control device which implements an operating function of the user interface.

The user interface may include the operating region and/or display region.

According to various embodiments, the head unit may furthermore include: a housing which includes a transfer opening for outputting and/or receiving one or a plurality of security documents. The transfer opening can be part of the first input/output interface and/or can be lockable, for example by means of a closure of the head unit.

According to various embodiments, a device may include the following: a security container for keeping available one or a plurality of security documents; a first inputting/outputting region and a second inputting/outputting region (which, for example, are disposed so as to be mutually spaced apart); a transfer assembly for transferring one or a plurality of security documents along a transport path; wherein the transfer assembly includes a head unit which is mounted so as to be displaceable to a plurality of positions relative to the security container, wherein the transfer assembly is specified for providing in a first (for example, advanced) position of the plurality of positions a transport path between the first inputting/outputting region and the head unit, in a second (for example, retracted) position of the plurality of positions a transport path between the second inputting/outputting region and the head unit, and in a third position a transport path between the security container and the head unit.

According to various embodiments, a device may include the following: a security container for keeping available one or a plurality of security documents; a first input/output interface and a second input/output interface; a head unit which is mounted so as to be displaceable to a plurality of positions relative to the security container and is specified for in a first (advanced) position of the plurality of positions, by means of the first input/output interface, receiving or outputting one or a plurality of security documents; in a second (retracted) position of the plurality of positions, by means of the second input/output interface, receiving or outputting one or a plurality of security documents; and in a third position of the plurality of positions receiving one or a plurality of security documents from the security container or for outputting said one or a plurality of security documents into said security container.

According to various embodiments, a method for operating a device which includes a first input/output interface and a second input/output interface; a head unit, and a security container, may include the following: transferring one or a plurality of security documents between the security container and at least one input/output interface of the two input/output interfaces; and displacing the head unit between at least two positions, of which: in a first position, by means of the first input/output interface, one or a plurality of security documents are transferred into or out of the head unit (for example, an automatic teller); in a second position, by means of the second input/output interface, one or a plurality of security documents are transferred into or out of the head unit; and in a third position one or a plurality of security documents are transferred between the head unit and the security container.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes, which come within the meaning and range of equivalency of the claims, are therefore intended to be embraced.

What is claimed is:

1. A device for at least one of inputting or outputting one or a plurality of security documents, the device comprising:

a security container for keeping available one or a plurality of security documents;

a first input/output interface and a second input/output interface;

a head unit which is mounted so as to be displaceable to a plurality of positions relative to the security container;

wherein the head unit is moveable between in a first position of the plurality of positions, by means of the first input/output interface, transfer one or a plurality of security documents into or out of the device;

in a second position of the plurality of positions, by means of the second input/output interface, transfer one or a plurality of security documents into or out of the device; and in a third position of the plurality of positions, transfer one or a plurality of security documents between the head unit and the security container.

2. The device of claim 1, wherein the head unit comprises the first input/output interface, or the first input/output interface is at least disposed so as to be locationally fixed in relation to the head unit.

3. The device of claim 1, wherein the head unit and the second input/output interface are disposed so as to be mutually spaced apart.

4. The device of claim 1, further comprising:

a control device configured to displace the head unit to the second position when the control device receives a transfer request that is assigned to the second input/output interface.

5. The device of claim 1, further comprising:

a transport device;

wherein the head unit is further configured to in the first position transfer the security document or documents between the first input/output interface and the transport device;

in the second position transfer the security document or documents between the second input/output interface and the transport device; and in the third position transfer the security document or documents between the security container and the transport device.

6. The device of claim 1, wherein the first input/output interface is disposed between the second input/output interface and the security container when the head unit is in the second position.

7. The device of claim 1, wherein the first input/output interface and the second input/output interface are configured to transfer the security document or documents among one another when the head unit is in the second position.

8. The device of claim 1, wherein the second input/output interface comprises a storage container and a manipulator;

wherein the manipulator is configured to transfer the security document or documents between the storage container and the head unit when the head unit is in the second position.

9. The device of claim 8, wherein the second input/output interface further comprises a container transport device configured to transport the storage container to the manipulator and away from the latter.

10. The device of claim 1, wherein the first input/output interface comprises a security document input module.

11. The device of claim 1, wherein the second input/output interface is disposed at least one of above or so as to be locationally fixed in relation to the security container.

12. The device of claim 1, wherein the first position and the second position differ from one another.

13. The device of claim 1, wherein the head unit comprises at least one of the following:

a display device;

an input device; and a card reader.

14. An assembly, comprising:

a wall element which comprises a passage opening;

a device, comprising:

a security container for keeping available one or a plurality of security documents;

a first input/output interface and a second input/output interface;

a head unit which is mounted so as to be displaceable to a plurality of positions relative to the security container;

wherein the head unit is moveable between in a first position of the plurality of positions, by means of the first input/output interface, transfer one or a plurality of security documents into or out of the device;

in a second position of the plurality of positions, by means of the second input/output interface, transfer one or a plurality of security documents into or out of the device; and in a third position of the plurality of positions, transfer one or a plurality of security documents between the head unit and the security container;

wherein the head unit in the first position extends into the passage opening or through the latter.

15. A method for inputting and/or outputting one or a plurality of security documents by a device which comprises a security container, a head unit, a first input/output interface and a second input/output interface; the method comprising:

transferring one or a plurality of security documents between the security container and at least one input/output interface of the two input/output interfaces; and displacing the head unit between at least two positions, of which:

in a first position, by means of the first input/output interface, the security document or documents are transferred into or out of the device;

in a second position, by means of the second input/output interface, the security document or documents are transferred into or out of the device; and in a third position, the security document or documents are transferred between the head unit and the security container.

* * * * *